US011667020B2

(12) United States Patent
Kuriki et al.

(10) Patent No.: US 11,667,020 B2
(45) Date of Patent: Jun. 6, 2023

(54) DRIVING TOOL

(71) Applicant: MAKITA CORPORATION, Anjo (JP)

(72) Inventors: Shun Kuriki, Anjo (JP); Yukiyasu Okouchi, Anjo (JP); Yoshitaka Akiba, Anjo (JP); Norikazu Baba, Anjo (JP)

(73) Assignee: MAKITA CORPORATION, Anjo (JP)

( * ) Notice: Subject to any disclaimer, the term of this patent is extended or adjusted under 35 U.S.C. 154(b) by 86 days.

(21) Appl. No.: 17/386,672

(22) Filed: Jul. 28, 2021

(65) Prior Publication Data

US 2022/0097219 A1 Mar. 31, 2022

(30) Foreign Application Priority Data

Sep. 30, 2020 (JP) ..... JP2020-165654
Jan. 22, 2021 (JP) ..... JP2021-008555

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
CPC .. B25C 1/047; B25C 1/04; B25C 1/06; B25C 1/008
See application file for complete search history.

(56) References Cited

U.S. PATENT DOCUMENTS 7,445,139 B2 * 11/2008 Okouchi ..... B25C 1/06 227/8
8,387,718 B2 3/2013 Leimbach et al.
2007/0102470 A1 * 5/2007 Miyashita ..... B25C 1/06 227/8
2020/0391364 A1 * 12/2020 Yasutomi ..... B25C 1/047

FOREIGN PATENT DOCUMENTS

JP 4749828 B2 8/2011

* cited by examiner

*Primary Examiner* — Anna K Kinsaul
*Assistant Examiner* — Veronica Martin
(74) *Attorney, Agent, or Firm* — Oliff PLC

(57) ABSTRACT

In a driving tool, during and/or after a driving operation has been completed, a restriction member is retained in an on-position by a cam. An energizing switch is retained in an on-state by an actuation portion of the restriction member. Because of this configuration, if a trigger is released during and/or after the driving operation has been completed, an electric motor continues to be activated, which causes a driver to return to a standby position.

18 Claims, 20 Drawing Sheets

DRIVING TOOL

CROSS-REFERENCE TO RELATED APPLICATIONS

This application claims priority to Japanese patent application serial number 2020-165654, filed on Sep. 30, 2020, and to Japanese patent application serial number 2021-008555, filed on Jan. 22, 2021, both the contents of which are incorporated herein by reference in their entirety for all purposes.

BACKGROUND

The present disclosure generally relates to a driving tool for driving a material, such as a nail or a staple, into a workpiece, such as, for example, a wooden material.

Driving tools, such as a gas-spring type driving tool and a mechanical-spring type driving tool, are well known. For instance, a gas-spring type driving tool, which is disclosed for example, U.S. Pat. No. 8,387,718B2, may include a driver for driving a driving material, a rack for moving the driver upward (in a direction opposite to a driving direction), and a wheel engaging the rack. The rack is formed on the driver and the driver is formed integral with a piston. After a driving operation has been completed, the wheel is rotated by an electric motor. This causes the wheel to engage the rack. Because of this configuration, the rack, the driver, and the piston move in the direction opposite to the driving direction. In this way, the piston returns in the direction opposite to the driving direction, thereby re-pressurizing a gas in a piston upper chamber (an accumulation chamber). By utilizing the pressure of the gas (which supplies a thrust power) in the accumulation chamber, the piston and the driver can be moved downward, thereby causing the driving material to be driven by the driver.

As another example, a mechanical-spring type driving tool, which is disclosed in, for example, Japanese Patent No. 4749828, may include a driver for driving a driving material, a compression spring for biasing the driver in a direction opposite to a driving direction, a roller engaging the driver in the driving direction and in the direction opposite to the driving direction, and a gear including the roller eccentrically positioned. After a driving operation is completed, an electric motor rotates the gear, and concomitantly the roller moves in a direction opposite to the driving direction. As a result, the driver moves against a compression spring in the direction opposite to the driving direction. Owing to a biasing force of the compression spring caused by the movement of the driver in the direction opposite to the driving direction, the driver may be moved downward in the driving direction, thereby driving another driving material.

In the above-mentioned types of driving tools, it is necessary to return the driver once it has reached its lower end position for performing a driving operation. The driver is returned by moving it in a direction opposite to the driving direction to place it in a standby position that is a little lower than its upper end position. For this reason, the electric motor needs to be continuously activated for a predetermined period of time after a trigger is off-operated. For example, in the above mentioned gas-spring type driving tool, an on/off operation of the trigger and an on/off switching of an energizing switch can be electrically controlled by a controller, thereby requiring the motor to remain activated for a predetermined period of time after a driving operation has been completed. However, the controller may have many actions to control, which might cause a malfunction of the driving tool for various reasons.

To avoid this, an on/off operation of the trigger of a driving tool can be selectably interlocked with an on/off operation of the energizing switch, for instance by using an interlocking member. This mechanical control may reduce a possibility of causing a malfunction in comparison with the above-mentioned electrical control configuration.

Thus, it may be preferable that a gas-spring type driving tool comprises a mechanical control configuration for continuously activating the electric motor after a driving operation has been completed. However, it has been difficult to apply a conventional mechanical control configuration to a gas-spring type driving tool.

In more detail, a mechanical-spring type driving tool is configured such that a driver is moved upward while a compression spring is compressed Because of this configuration, it may be possible to apply a three for compressing the compression spring by using an engagement roller positioned apart from the compression spring. In contrast, a gas-spring type driving tool is configured such that an external force for moving the driver upward is preferably directly applied to the driver in order to avoid applying an unbalanced load to the driver. Because of this configuration, it has been difficult to apply a conventional mechanical control configuration, in which a gear is positioned apart from the trigger, to a gas-spring type driving tool. Thus, there is a need to provide a gas-spring type driving tool in which the electric motor is continuously activated by a mechanical control configuration after a driving operation has been completed.

SUMMARY

According to one feature of the present disclosure, a driving tool includes a cylinder, a piston that is housed within the cylinder so as to be reciprocated in an up-down direction, and a driver that is fixed to the piston and moves downward in a driving direction. A lift wheel engages with a rack provided in the driver. An electric motor rotates the lift wheel. A trigger is movable to an on-position. An energizing switch is switched on to cause the electric motor to be activated by a movement of the trigger to the on-position. A restriction member is movable between a lock position, where the energizing switch is retained in an on-state, and an unlock position, where the energizing switch is allowed to be in an off-state. The driving tool further includes a cam configured to be interlocked with the lift wheel. The cam includes: (i) an on-area, with which the restriction member engages such that the restriction member is retained in the lock position; and (ii) an off-area, where the restriction member is allowed to move to the unlock position.

Because of this configuration, the restriction member is retained in the lock position by the cam. The lock position maintains the on-state of the energizing switch, which causes the electric motor to continue to be activated regardless of the on-operation of the trigger. Because of this configuration, i.e., because of a mechanical configuration including the restriction member and the cam, in a gas-spring type driving tool, an activation state of the electric motor continues after the driving operation has been completed, regardless of the operation state of the trigger. This allows the driver to return to the standby position.

According to another feature of the present disclosure, the restriction member is moved to the lock position by moving the trigger to the on-position. In other words, the movement operation of the trigger toward the on-position can be associated with the movement of the restriction member toward the lock position. Because of this association, a configuration in which the energizing switch is retained in the on-state can be simplified. In contrast, if a member for restricting a movement of the operation portion of the energizing switch were to be provided separately from a member that the trigger contacts, the trigger may be configured not to be associated with the restriction member.

According to another feature of the present disclosure, the cam is rotatable coaxially with the lift wheel. Because of this configuration, the cam can be positioned in a compact manner.

According to another feature of the present disclosure, the on-area of the cam has a first radius, and the off-area of the cam has a second radius that is smaller than the first radius. In other words, the cam includes the on-area (which may correspond to a large-radius portion) and the off-area (which may correspond to a small-radius portion) along a rotational direction. The restriction member engages the on-area to lock the on-state of the energizing switch. In contrast, the restriction member engages with the off-area to release the on-state of the energizing switch. A state can be changed between the lock-state, where the on-state of the energizing switch is locked, and the unlock-state, where the on-state of the energizing switch is released, by rotation of the cam.

According to another feature of the present disclosure, the restriction member engages the on-area of the cam when the driver moves from a lower end position to a predetermined position. The predetermined position is a standby position or a position in a vicinity of the standby position. The restriction member engages the on-area of the cam to lock the on-state of the energizing switch, which causes the activation state of the electric motor to continue. Because of this configuration, the driver returns from the lower end position to the standby position in a reliable manner.

According to another feature of the present disclosure, the restriction member and the cam are positioned between the trigger and the driver, in a side view from the driver and the trigger. The restriction member and the cam can be positioned in an area where a required space can be obtained in a relatively easily manner. Thus, the restriction member and the cam can be positioned in a compact manner.

According to another feature of the present disclosure, the driving tool further includes guide rollers that guide the movement of the restriction member. Because of this configuration, the guide rollers guide the restriction member such that the restriction member moves smoothly.

According to another feature of the present disclosure, the guide rollers are positioned on sides of the restriction member, such that when the cam applies a force to the restriction member in a direction perpendicular to an up-down direction, which is a direction in which the restriction member moves, the restriction member receives an opposite force from the rollers. Because of this configuration, the restriction member moves smoothly between the lock position and the unlock position, even while the restriction member is receiving a force from the cam in a direction perpendicular to the up-down direction, which is a direction in which the restriction member moves.

According to another feature of the present disclosure, the guide rollers are positioned to guide the restriction member on at least one side in a direction parallel to a rotation axis of the cam, which is also perpendicular to the direction in which the restriction member moves. Because of this configuration, the restriction member is guided by at least one of the guide rollers in a direction perpendicular to a rotation axis of the guide rollers. Thus, the restriction member can move smoothly.

According to another feature of the present disclosure, a driving operation is performed, when both the trigger and a contact lever are on-operated. This causes an idler of the trigger to be engaged with an operation portion of the contact lever and then switch on the energizing switch. The driving operation includes a single shot mode and a continuous shot mode. In the single shot mode, when the contact lever is on-operated after the trigger is on-operated, the idler disengages from the operation portion of the contact lever to cause the energizing switch not to be switched on. In the continuous shot mode, the idler engages the operation portion of the contact lever to cause the energizing switch to be switched on, regardless of an order of the on-operation of the trigger and the on-operation of the contact lever. The single shot mode and the continuous shot mode are selectable by shifting a position of the trigger relative to a housing of the driving tool.

According to this feature, the driving operation can be switched between the single shot mode and the continuous shot mode by changing the position of the trigger. In the single shot mode, the driving operation can be performed when the trigger is on-operated after the contact lever is on-operated. In case where the trigger is on-operated before the contact lever is on-operated, the energizing switch is not switched on because the operation portion of the contact lever does not engage with the idler of the trigger. As a result, the driving operation cannot be performed. In contrast, in the continuous shot mode, the operation portion of the contact lever engages the idler of the trigger to cause the energizing switch to be switched on, regardless of an order of the on-operation of the trigger and the on-operation of the contact lever. As a result, the driving operation can be performed. The single shot mode and the continuous shot mode can be changed according to various work conditions. In this respect, operability of the driving tool can be improved.

According to another feature of the present disclosure, the restriction member is positioned between the energizing switch and the idler. Both the on-operation of the trigger and the on-operation of the contact lever cause the idler to push the restriction member, which in turn causes the restriction member to move to the lock position. The restriction member moves the lock position to cause the energizing switch to be switched on, thereby performing the driving operation. In other words, by use of the restriction member which restricts the on-state of the energizing switch, the energizing switch can be switched on, thereby simplifying the configuration of driving tool.

DETAILED DESCRIPTION

The detailed description set forth below, when considered with the appended drawings, is intended to be a description of exemplary embodiments of the present disclosure and is not intended to be restrictive and/or to represent the only embodiments in which the present disclosure can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the disclosure. It will be apparent to those skilled in the art that the exemplary embodiments of the disclosure may be practiced without these specific details. In some instances, these specific details refer to well-known structures, components, and/or devices that are shown in block diagram form in order to avoid obscuring significant aspects of the exemplary embodiments presented herein.

Figure 1:
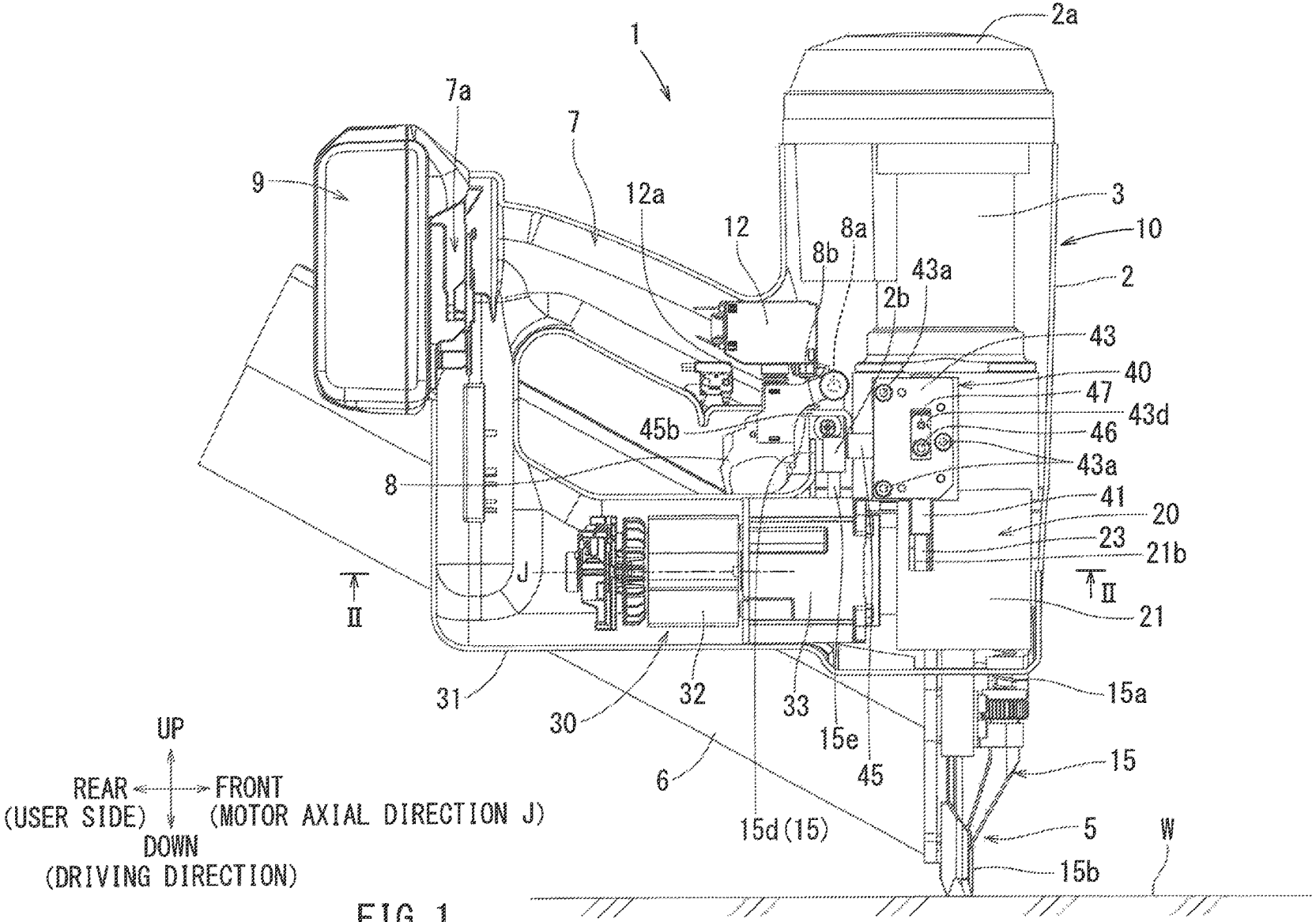
FIG. 1 is an overall right side view of a driving tool according to an exemplary embodiment of the present disclosure.
Figure 5:
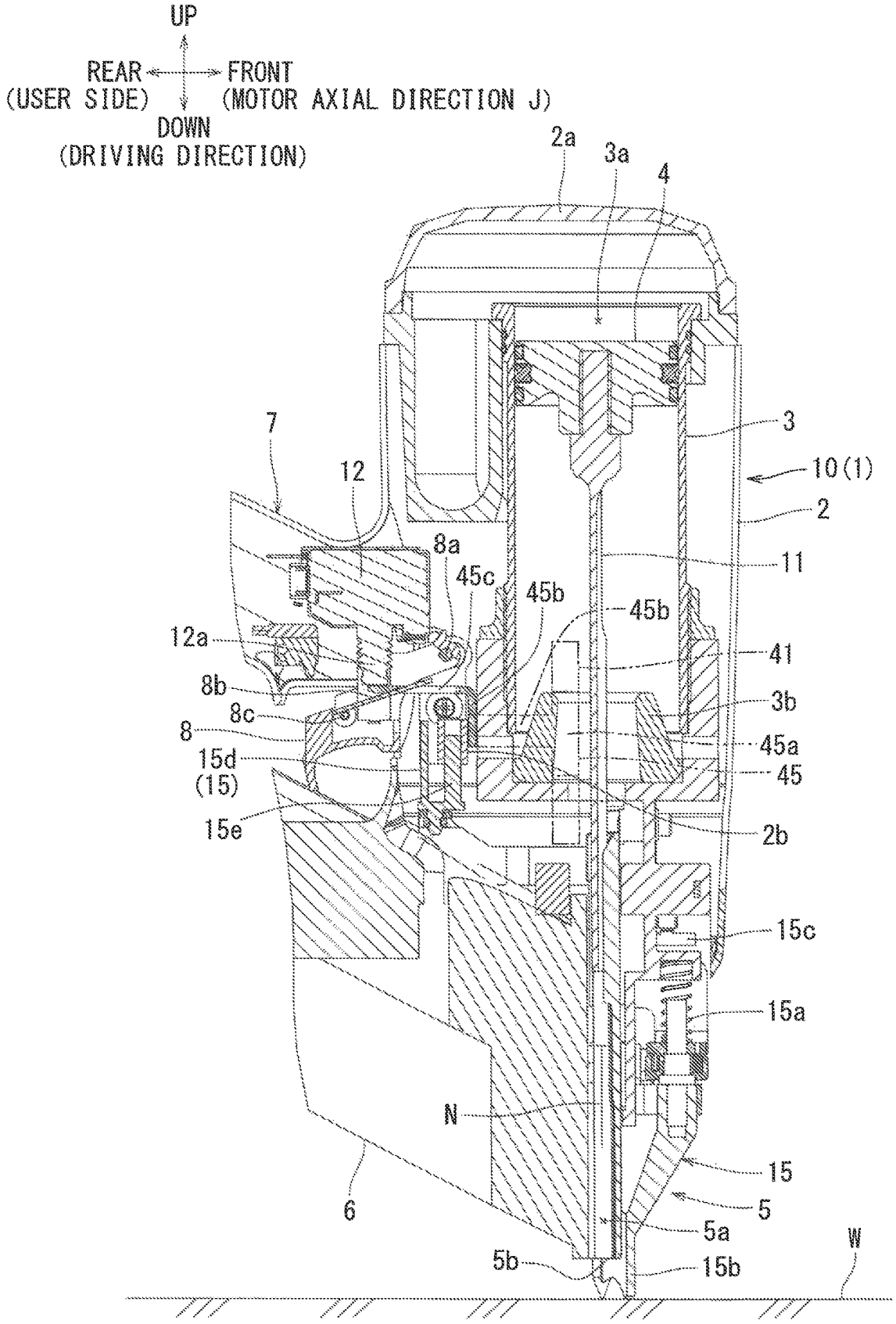
FIG. 5 is a longitudinal sectional view of the tool main body, showing a stand-by state of the driving tool, similar to FIG. 4.

A driving tool 1 according to an embodiment of the present disclosures will be described with reference to FIGS. 1 to 23. In the embodiment, a gas-spring type driving tool 1 will be exemplified as the driving tool 1. The gas-spring type driving tool 1 utilizes the pressure of a gas filled in a piston upper chamber as a driving three for driving a driving member N. FIG. 1 shows the driving tool 1 according to the embodiment of the present disclosure. In FIG. 5, a nail is exemplified as the driving member N. In the following explanation, a driving direction of the driving member N is a downward direction, and a direction opposite to the driving direction is an upward direction. When a driver 11 moves downward, the driving member N may be driven. After that, the driver 11 may move upward to be returned to its original position. The driver 11 will be discussed later in detail. In FIG. 1, a user of the driving tool 1 may be generally situated on a left side of the driving tool 1. A side nearer to the user is a rear side (user side), and a side in a forward direction is a front side. Also, a left and right side are based on a user's position.

Figure 6:
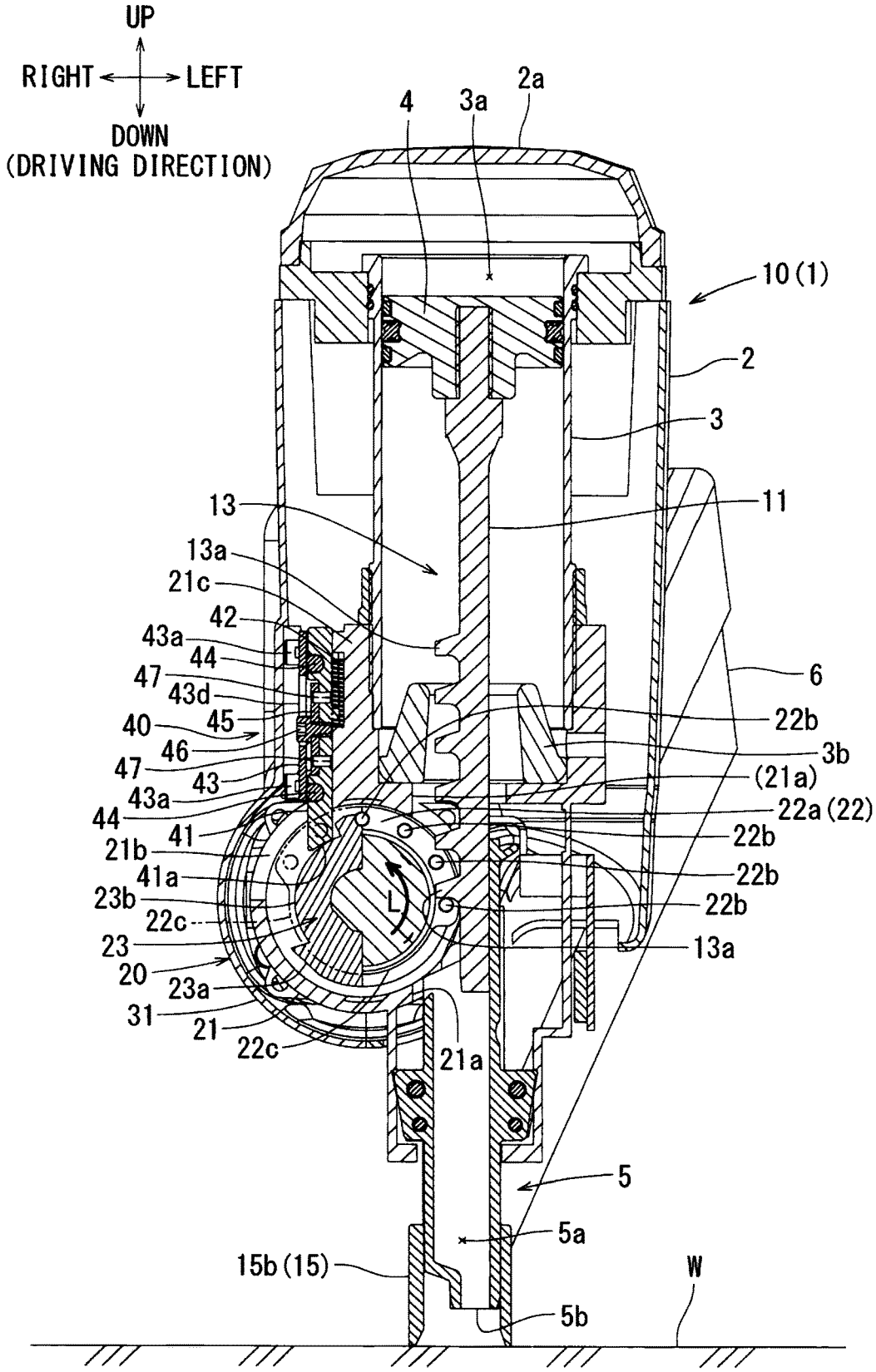
FIG. 6 is a cross-sectional view taken along line VI-VI of FIG. 4, showing a longitudinal sectional view of the tool main body.

As shown in FIGS. 5 and 6, the driving tool 1 may include a tool main body 10. The tool main body 10 may house a cylinder 3 within a tubular main body housing 2. The cylinder 3 may support a driving piston 4 so that the driving piston 4 may be reciprocated in an up-down direction. A driver 11 for driving a driving member N may be provided to extend downward from a center of a lower surface of the driving piston 4. The driving piston 4 and the driver 11 may be integrally provided, so that they may be reciprocated together within the cylinder 3 in the up-down direction. The driver 11 may extend in the downward direction. A tip end of the driver 11 may enter a driving passage 5*a* of a driving nose 5. The driving nose 5 may be provided at a lower end of the tool main body 10. As shown in FIG. 6, a rack 13 may be provided on a right side of the driver 11. The rack 13 may include a plurality of engaging teeth 13*a*. In FIG. 6, the rack 13 may include six engaging teeth 13*a*.

A lower end of the driving nose 5 may be an ejection port 5*b*. The driving member N is driven out of the ejection port 5*b*. FIGS. 5 and 6 show that the piston 4 is retained in a standby state where the piston 4 is around an upper portion of the cylinder 3.

A contact lever 15 may be around the driving nose 5. The contact lever 15 may move in the up-down direction relative to the driving nose 5. The contact lever 15 may be biased via a compression spring 15*a* to be displaced downward. A contact portion 15*b* may be formed at a lower end of the contact lever 15. As shown in FIG. 5, the contact portion 15*b* may protrude downward of the ejection port 5*b* before a driving operation. When the contact portion 15*b* contacts a workpiece W and the driving tool 1 is pushed downward, the contact lever 15 may move upward relative to the driving nose 5. A contact sensor 15*c* may detect the upward movement (an on-operation) of the contact lever 15 relative to the driving nose 5. In some embodiments, the driving operation can be performed on a condition that the on-operation of the contact lever 15 is detected by the contact sensor 15*c*.

A handle 7 for a user to hold may be provided on a lateral side of the main body housing 2. A trigger 8 for the user to pull with a finger may be provided on a lower side of the base portion of the handle 7. As shown in FIG. 5, the trigger 8 may move in an up-down direction around a trigger pivot 8*a*. A plate-shaped idler 8*b* may be provided on an upper surface of the trigger 8. A rear end of the idler 8*b* may be supported on an upper surface side of the trigger 8 via a idler pivot 8*c*. The idler 8*b* may be supported so as to move in an up-down direction around the idler pivot 8*c*.

Figure 10:
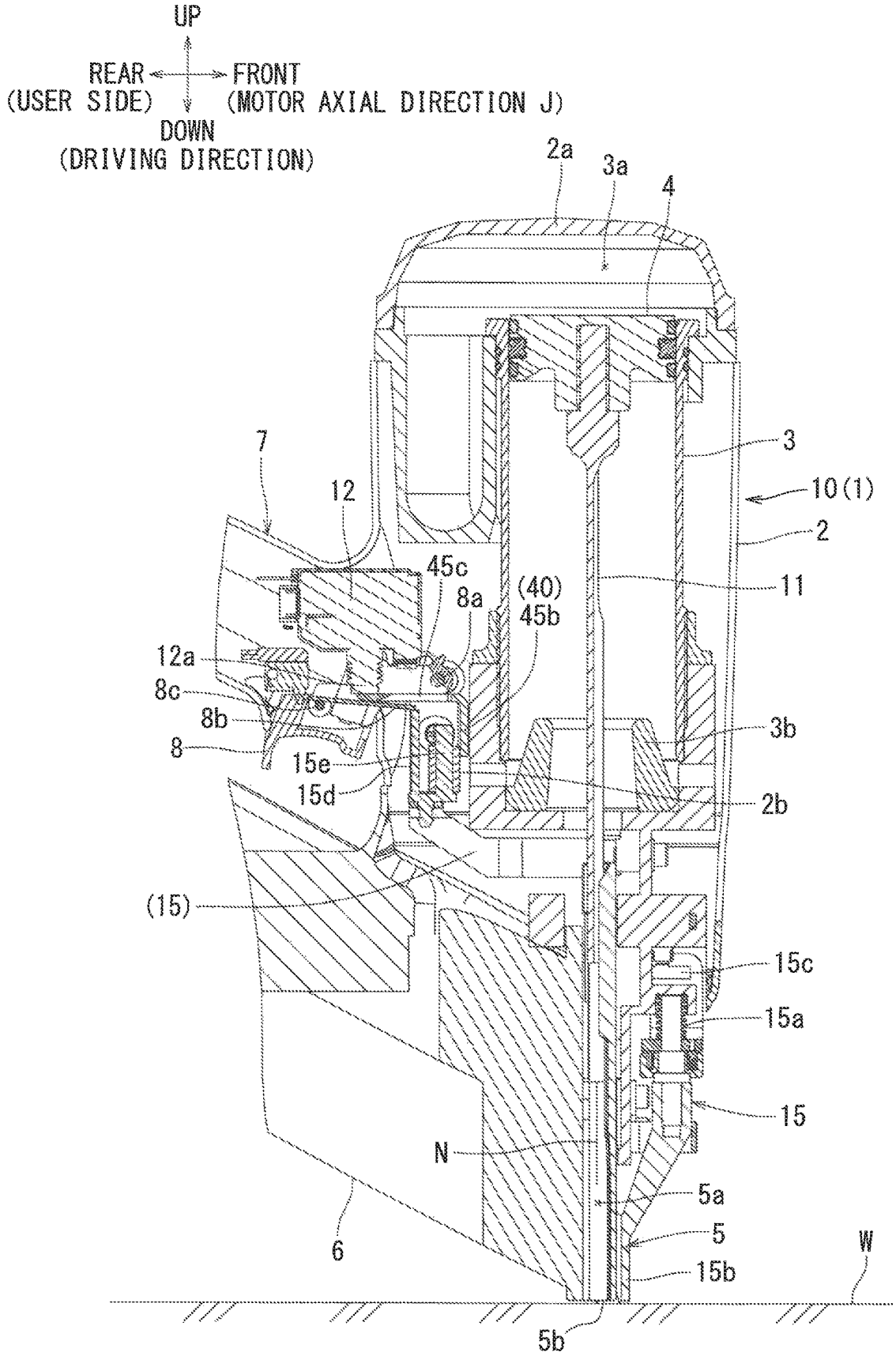
FIG. 10 is a longitudinal sectional view of the tool main body, showing a state immediately before a driving operation is performed, similar to FIG. 9.

As shown in FIGS. 5 and 10, an upper side of the contact lever 15 may extend to a vicinity of a lower side of the trigger 8. An operation portion 15*d* and a support portion. 15*e* may be provided on the upper side of the contact lever 15. The operation portion 15*d* may reach below a lower side of the idler 8*b*. The support portion 15*e* may pass through a support tubular portion 2*b* that is integrally formed with the main body housing 2. Because of this configuration, the contact lever 15 may move in the up-down direction relative to the tool main body 10. In a single shot mode, which will be explained later in detail and is shown in FIG. 10, when the contact lever 15 is operated at first, the operation portion 15*d* may move closer to the idler 8*b*. Because of the operation portion 15*d* which moves closer to the idler 8*b*, a rotation tip side of the idler 8*b* may be restricted from moving in a downward direction. Owing to the rotation restriction of the idler 8*b*, the trigger 8 may be effectively pull-operated. By pulling the trigger 8 in an effective manner, an operation portion 12*a* of an energizing switch 12 may be pushed upward by the idler 8*b*. Because of this configuration, the energizing switch 12 may be switched on.

In the single shot mode, which is shown in FIGS. 5 and 10, when the contact lever 15 is not on-operated at first, the operation portion 15*d* may be disposed below and far from the idler 8*b* and be in a retracted manner. Because of this configuration, when the trigger 8 is pull-operated at first, the rotation tip side of the idler 8*b* may not be restricted from moving in the downward direction since the operation portion 15*d* has not yet been moved closer to the idler 8*b*. Thus, the rotation tip side of the idler 8*b* may rotate downward and the operation portion 12*a* of the energizing switch 12 may not be pushed into the on state. Accordingly, a pull-operation of the trigger 8 may not be effective at causing the energizing switch 12 to be switched on. Thus, a driving operation may not be performed. Using the structure described above, in the single shot mode, when the contact lever 15 is on-operated at first and then the trigger 8 is on-operated, a driving operation may be performed. A continuous mode will be discussed later in detail.

The energizing switch 12 may be disposed above the trigger 8 on a front side of the handle 7. The energizing switch 12 may include the operation portion 12*a* on a lower surface side of the energizing switch 12. The energizing switch 12 may be switched on when the operation portion 12*a* is pushed upward by the pull operation of the trigger 8. When the energizing switch 12 is switched on, the electric motor 32 may be actuated. The electric motor 32 will be discussed in detail later.

Figure 2:
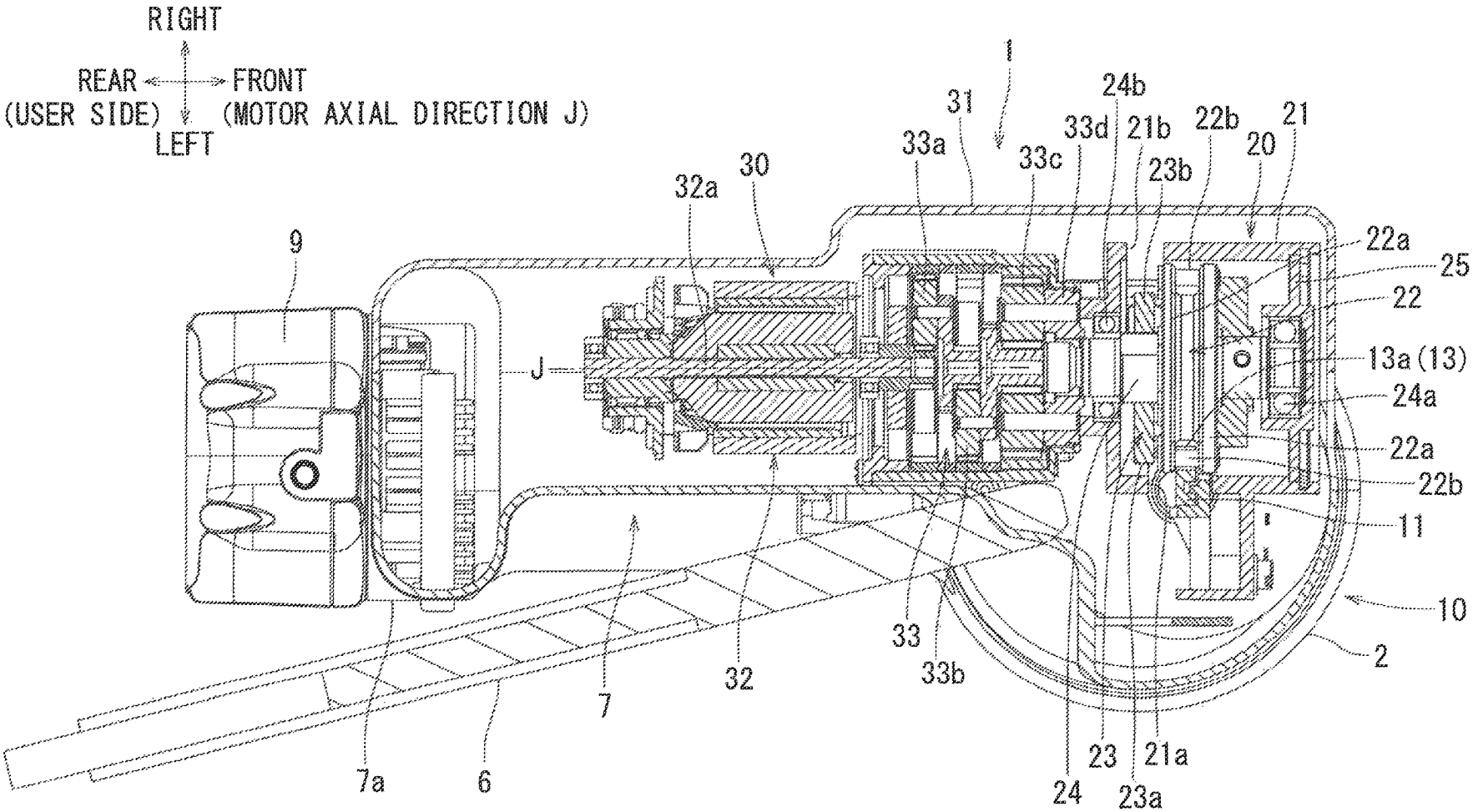
FIG. 2 is a cross-sectional view taken along line II-II of FIG. 1, showing a transverse cross-sectional view of a driving unit and a lift unit.

As shown in FIGS. 1 and 2, a battery attachment portion 7*a* for attaching a battery pack 9 serving a power source may be provided on a rear side of the handle 7. A slide-attachment-type battery pack, which comprises lithium-ion batteries, may be used as the battery pack 9. Generally, the battery pack 9 may have a rectangular parallelepiped shape. The battery pack 9 may be attached to the battery-attachment portion 7*a* by sliding the battery pack 9 downward from above with respect to the battery attachment portion 7*a*. In contrast, the battery pack 9 may be detached from the battery attachment portion 7*a* by sliding the battery pack 9 upward from below with respect to the battery attachment portion 7*a* while an unlock button (not shown in the figures) is being pushed. The battery pack 9 may be rechargeable and may be detached from the driving tool 1 in order to use it as a power source for another electric power device. A magazine 6, in which a plurality of driving members N is loaded, may be combined with the driving nose 5.

As shown in FIGS. 1-4 and 6, a lift unit 20 for moving the piston 4 and the driver 11 in an upward direction may be provided. The lift unit 20 may be generally located above the driving nose 5 on a right side of the tool main body 10. As shown in FIGS. 5 and 6, when the piston 4 is retuned upward by the lift unit 20, a gas pressure in a cylinder upper chamber 3*a* disposed above an upper surface of the piston 4 may be increased. The piston 4 may move downward owing to the increased gas pressure in the cylinder upper chamber 3*a*. The downward movement of the piston 4 may cause the driver 11 to drive the driving member N. A thrust force for the driving operation may be stored in the cylinder upper chamber 3*a* owing at least in part to the upward movement of the piston 4. The cylinder upper chamber 3*a* may be tightly sealed by a cover 2*a* attached to an upper portion of the main body housing 2. A lower end damper 3*b* for absorbing an impact that the piston 4 receives may be disposed on a lower side of the cylinder 3.

As shown in FIGS. 1 and 2, a driving unit 30 may be positioned around the lift unit 20. The driving unit 30 may drive the lift unit 20. The driving unit 30 may be housed in a driving unit case 31 that straddles the lift unit 20 as well as a lower portion of the battery attachment portion 7*a* in roughly an L-shaped manner. The driving unit case 31 may be formed integrally with the main body housing 2. The lift unit 20 may be covered by the driving unit case 31.

The driving unit 30 may include an electric motor 32. The electric motor 32 may be housed in the driving unit 30, such that an output shaft 32*a* (a motor axis J) of the electric motor 32 extends in a front-rear direction, i.e., in a direction perpendicular to the driving direction. The electric motor 32 may be actuated by power supplied from the battery pack 9*a*, which serves as the power source. As discussed earlier, the electric motor 32 may be actuated by the on-operation of the energizing switch 12.

The output shaft 32*a* of the electric motor 32 may be coupled to a reduction gear train 33. The reduction gear train 33 may include planetary gear trains 33*a*, 33*b*, 33*c*. The planetary gear trains 33*a*, 33*b*, 33*c* may be positioned coaxial with the motor axis J. A rotation output of the electric motor 32 may be reduced by the planetary gear trains 33*a*, 33*b*, 33*c*, and may be output to the lift unit 20.

Figure 3:
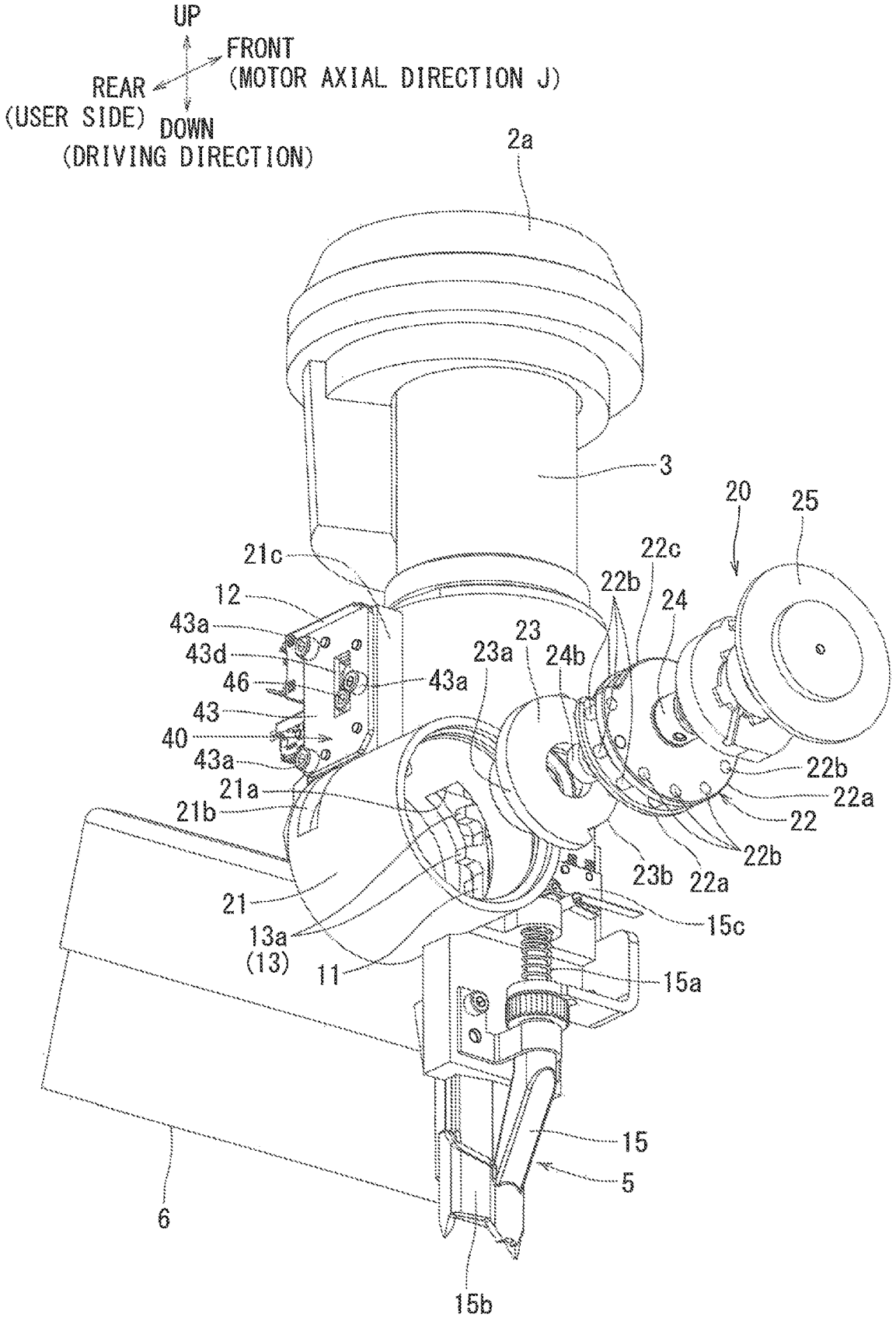
FIG. 3 is an exploded perspective view of the lift unit.
Figure 4:
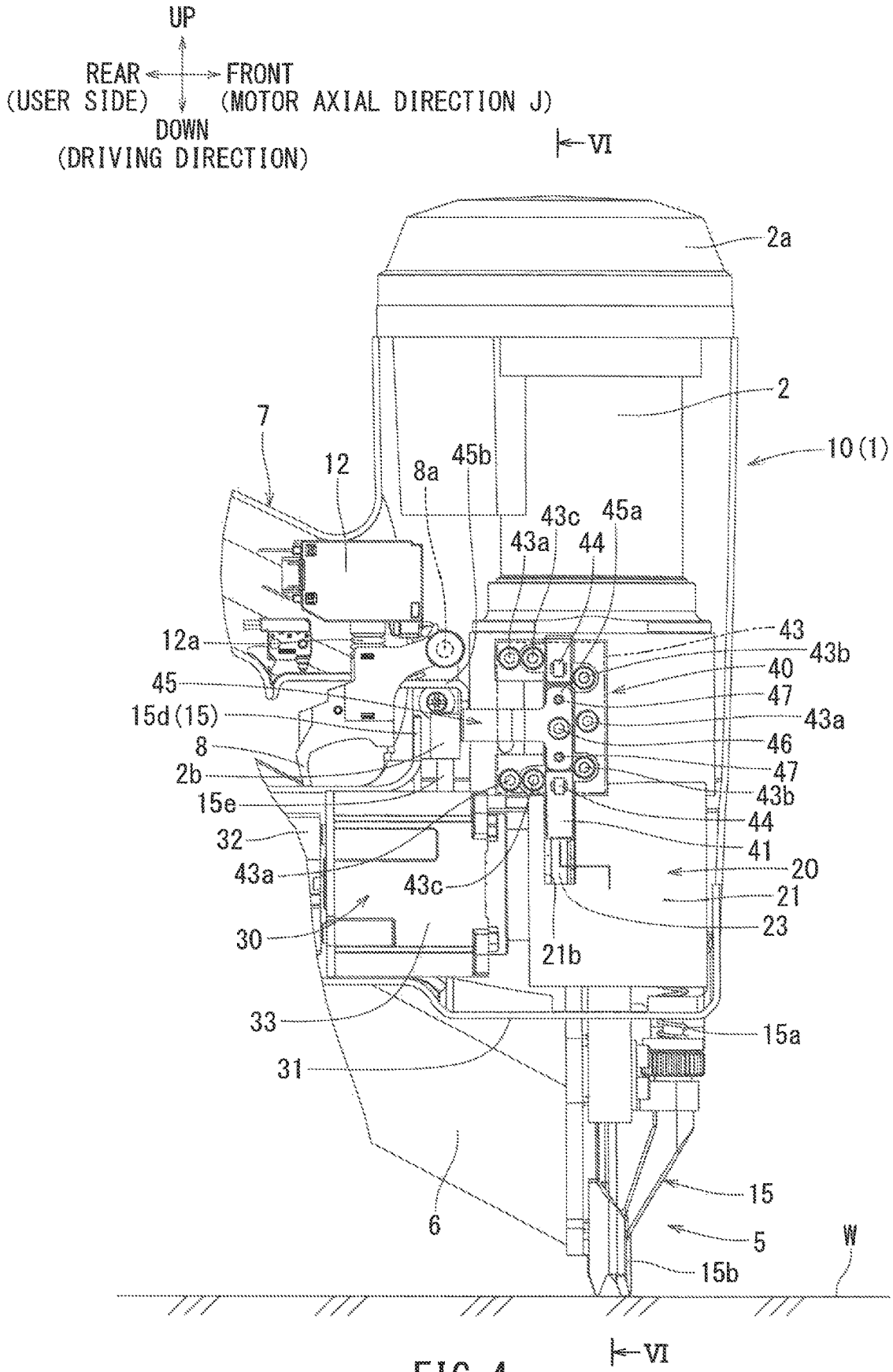
FIG. 4 is a right side view of a tool main body of the driving tool, showing a stand-by state of the driving tool.

As shown in FIGS. 2, 3, and 6, the lift unit 20 may include a tubular case 21 for a driving mechanism (hereinafter referred to as the mechanism case 21). The mechanism case 21 may be integrally formed with the main body housing 2. The mechanism case 21 may be disposed on the right side of a portion which straddles the driving nose 5, as well as the tool main body 10. A lift wheel 22 and a cam 23 may be housed within the mechanism case 21. As shown in FIG. 2, the lift wheel 22 may be coaxially connected to the cam 23 via a support shaft 24. The lift wheel 22 may be connected to the cam 23 such that they cannot be moved in an axial direction. Also, the lift wheel 22 may not be rotatable relative to the cam 23 around the support shaft 24. In other words, the lift wheel 22 may rotate together with the cam 23. As indicated by an arrow L in FIGS. 6, 8, 11, and 14, the lift wheel 22 and the cam 23 may rotate counterclockwise when viewed from the front.

As shown in FIG. 2, the support shaft 24 may be supported so as to be rotatable relative to the mechanism case 21 via a front bearing 24*a* and a rear hearing 24*b*. A front side of the mechanism case 21 may be covered by a cover 25. The front bearing 24*a* may be retained by the cover 25. The rear bearing 24*b* may be retained by a bottom portion of the mechanism case 21.

A rotation axis of the support shaft 24 may align with the motor axis J. A rear end of the support shaft 24 may be coupled to an output portion of the reduction gear train 33, i.e., a carrier 33*d* of the third planetary gear train 33*d*. When the electric motor 32 is activated, the lift wheel 22 may rotate integrally with the cam 23 around the motor axis J via the reduction gear train 33.

As shown in FIGS. 2 and 3, the lift wheel 22 may include two flange portions 22*a* that are parallel to each other and spaced apart from each other by a predetermined length. A plurality of engagement pins 22*b*, for example six in the present embodiment, may be provided between the two flange portions 22*a*. The engagement pins 22*b* may be provided such that each end of the engagement pin 22*b* are respectively supported on a peripheral edge of the corresponding flange portion 22*a*. As shown in FIG. 6, each of the engagement pins 22*b* may engage a corresponding engagement tooth 13*a* of a rack 13 of the driver 11. The plurality of engagement pins 22*b* may be provided in a predetermined area in a circumferential direction of the lift wheel 22. As shown in FIGS. 3 and 6, six engagement pins 22*b* may be disposed at equal intervals in an area within approximately one half of the circumference of the lift wheel 22. A residual circumferential area, where the plurality of engagement pins 22*b* is not disposed, may be a recessed portion 22*c* of the flange portion 22*a*. The recessed portion 22*c* may be a portion of the flange portion in which its radius is reduced.

As shown in FIGS. 2 and 3, two windows 21*a*, 21*b* may be provided in the mechanism case 21. The one window 21*a* may be disposed to be slightly offset relative to the other window 21*b* in the direction of the motor axis J. In more detail, as shown in FIG. 2, the window 21*a* on the left side may be disposed to be slightly offset toward a front side in the direction of the motor axis J, in comparison to the window 21*b* on the right side. As shown in FIG. 3, the rack 13 of the driver 11 may enter the left window 21*a*. The left window 21*a* may be provided in an area of the mechanism case 21 where each engagement tooth 13*a* of the rack 13 is allowed to enter within the mechanism case 21 and to move out thereof when the rack 13 moves in an up-down direction. The engagement teeth 13*a* that enter the mechanism case 21 may engage a corresponding engagement pin 22*b* of the lift wheel 22.

When the recessed portion 22*c* of the lift wheel 22 faces the left window 21*a*, the engagement pins 22*b* may be positioned away from the rack 13. In this case, the engagement pins 22*b* may not engage the engagement teeth 13*a* of the rack 13. Because of this arrangement, a downward movement of the driver 11 may be performed without interference from the lift wheel 22.

As shown in, for example, FIGS. 3 and 6, a restriction member 41 of an activation-state lock mechanism unit 40 may enter the right window 21*b*. The restriction member 41 that enters the mechanism case 21 through the right window 21*b* may engage the cam 23. The cam 23 may roughly be a circular cam plate that includes an on-area 23*a* and an off area 23*b*. The on-area 23*a* of the cam 23 may be formed to have a large radius, the large radius being a first predetermined length from a rotation center of the cam 23. The off-area 23*b* of the cam 23 may be formed to have a small radius, the small radius being a second predetermined length from the rotation center of the cam 23.

The on-area 23*a* may extend in an area where the restriction member 41 may interfere with the cam 23. This interference may occur while the driver 11 moves from the lower end position to the standby position, however other ranges of interference may also be possible. In the present embodiment, the on-area 23*a* may cover roughly three-fourths of the cam 23 in the circumferential direction. The off-area 23*b*, the radius of which is smaller than that of the on-area 23*a*, may cover roughly one-fourth of the cam 23 in the circumferential direction. The driver 11 may be configured to return to the standby position when a lower portion of the restriction member 41 extends beyond the on-area 23*a* and toward the off-area 23*b*.

Figure 7:
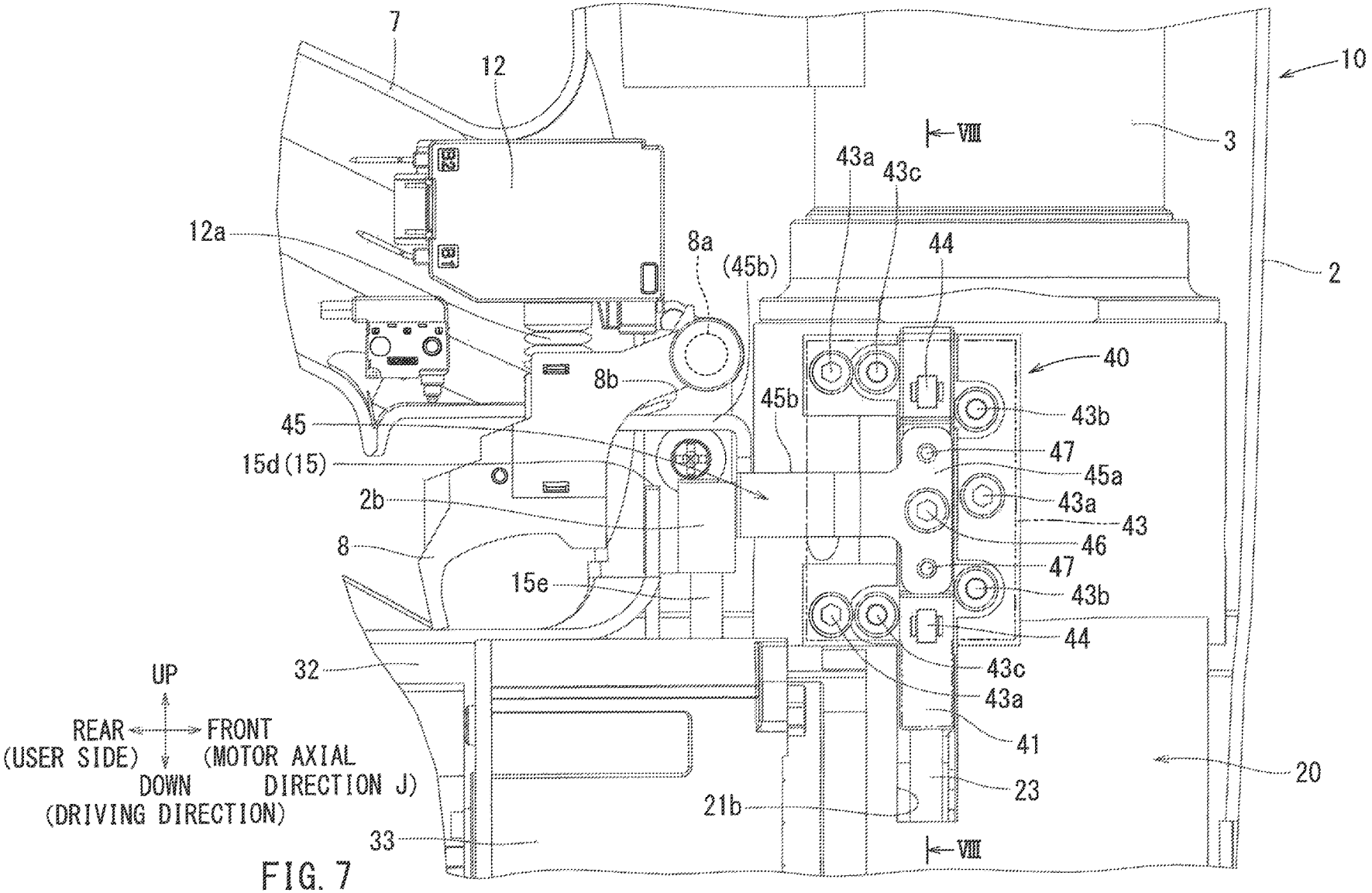
FIG. 7 is a right side enlarged view of an activation-state lock mechanism section, showing an enlarged view of a corresponding part in FIG. 4.
Figure 8:
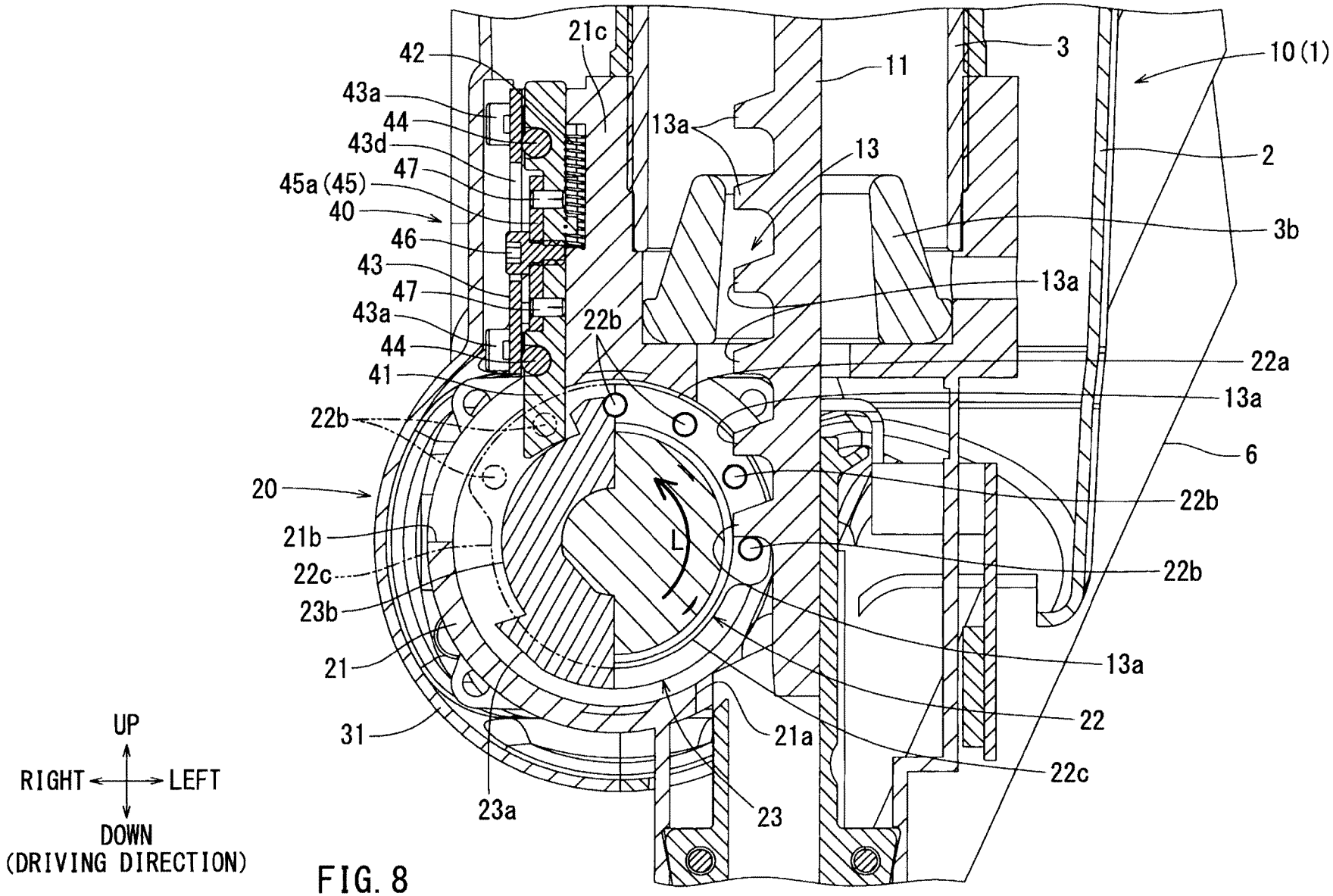
FIG. 8 is a cross-sectional view taken along line of FIG. 7, showing a longitudinal cross-sectional, view of the lift unit and the activation-state lock mechanism section. This figure shows an enlarged view of a corresponding part in FIG. 6.

The activation-state lock mechanism unit 40 may have a feature in which it keeps an activation state of the electric motor 32. This may be done by temporarily locking an on-state of the energizing switch 12. Because of this feature, if the user releases an on-operation of the trigger 8 before or after a driving operation has been completed, the electric motor 32 may continue to be activated for a period of time. FIGS. 7 and 8 shows an embodiment of the activation-state lock mechanism unit 40 in detail.

The activation-state lock mechanism unit 40 may include a restriction member 41 and a restriction arm 45. As shown in FIG. 8, the restriction member 41 may be a bar shaped member having a rectangular cross section. The restriction member 41 may be supported by a mounting portion 21*c*. The mounting portion 21*c* may be integrally provided with the mechanism case 21. Referring to FIG. 3, the mounting portion 21*c* may be disposed above the mechanism case 21 so as to extend upward from between the left window 21*a* and the right window 21*b*. The lower portion of the restriction member 41 may enter the mechanism case 21 through the right window 21*b*. The lower portion of the restriction member 41 may enter the mechanism case 21 and may engage the cam 23.

As shown in FIGS. 6 and 8, the restriction member 41 may be spring-biased in a downward direction by a compression spring 42. Because of this configuration, the lower portion of the restriction member 41 may engage the on-area 23*a* of the cam 23 or may approach the off-area 23*b* of the cam 23 owing to the biasing force of the compression spring 42. In more detail, when the portion of the cam 23 that faces the lower portion of the restriction member 41 changes from the on-area 23*a* to the off-area 23*b*, according to rotational orientation of the cam 23, the lower portion of the restriction member 41 may approach the off-area 23*b* owing to the downward biasing force of the compression spring 42. In contrast, when the portion of the cam 23 that faces the lower portion of the restriction member 41 changes from the off-area 23*b* to the on-area 23*a*, according to rotational orientation of the cam 23, the lower portion of the restriction member 41 may be moved in an upward direction against the force of the compression spring 42. Accordingly, the lower portion of the restriction member 41 may be able to engage the on-area 23*a*. In the present embodiment, when the trigger 8 is pulled, the restriction member 41 may be configured to move upward against the force of the compression spring 41.

The lower portion of the restriction member 41 may have an arc surface 41*a*, the curvature of which equals that of the on-area 23*a* of the cam 23. The arc surface 41*a* may slide-contact the on-area 23*a* of the cam 23. In other words, the restriction member 41 may engage the cam 23 in a surface-contact manner. Because of this configuration, the restriction member 41 may smoothly and slidably contact the cam 23, thereby avoiding uneven wear of the restriction member 41 and the earn 23.

As shown in FIG. 8, the restriction member 41 may be supported between the mounting portion 21*c* and a mechanism cover 43. As shown in FIGS. 1, 3, 4, and 7, the mechanism cover 43 may have a rectangular flat plate shape. The mechanism cover 43 may be fixed to the mounting portion 21*c* by using three fixing screws 43*a*. As shown in FIGS. 4 and 6-8, two side rollers 44 may be disposed on the right side of the restriction member 41. The two side rollers 44 may contact the mechanism cover 43, thereby preventing the two side rollers 44 from falling away from the restriction member 41. The two side rollers 44 may be retained such that each axis of the two side rollers 44 extend in the front-rear direction (in the direction of the motor axis J). The two side rollers 44 may be separated by a fixed distance in the up-down direction. Because of this configuration, when the restriction member 41 moves in the up-down direction, the two side rollers 44 may roll on the mechanism cover 43, thereby guiding the up-down movement of the restriction member 41. Also, because the two side rollers 44 roll on the mechanism cover 44, a rightward outer three that the lower portion of the restriction member 41 receives from the cam 23 may be reliably received by the mechanism cover 43. Because of this configuration, the restriction member 41 may be prevented from rattling, especially in the left-right direction.

As shown in FIG. 7, two first rollers 43*b* and two second rollers 43*c* may be disposed between the mechanism cover 43 and the mounting portion 21*c*. The two first rollers 43*b* may be located on the front side and may contact a front surface of the restriction member 41. The two second roller 43*c* may be located on the rear side and may contact a rear surface of the restriction member 41. Because of the presence of the two first rollers 43*b* and the two second rollers 43*c*, the restriction member 41 may be guided in a direction perpendicular to the movement direction of the restriction member 41 (e.g., in the up-down direction).

Each rotation axis of the first roller 43*b* and the second roller 43*c*, which is a direction perpendicular to a paper surface of FIG. 7, may be perpendicular to rotation axes of the side rollers 44, which is a direction parallel to a paper surface in FIG. 7. The two first rollers 43*b* and the two second rollers 43*c* may be disposed on the front side and the rear side of the restriction member 41, respectively. A distance between the two second rollers 43*c* on the rear side may be slightly larger than that between the two first rollers 43*b* on the front side in the up-down direction. Because of the presence of the two first rollers 43*b* on the front side and the two second rollers 43*c* on the rear side, the restriction member 41 may be prevented from rattling in the front-rear direction. Thus, the restriction member 41 may be guided to move smoothly in the up-down direction. The two side rollers 44, the two first roller 43*b*, and the two second roller 43*c* may serve as guiding rollers to guide the restriction member 41 to move smoothly relative to the cam 23 in the up-down direction (engagement direction and disengagement direction).

As shown in, for example, FIGS. 7 and 8, a coupling portion 45*a* of the restriction arm 45 may be coupled to the right side portion of the restriction member 41. The coupling portion 45*a* may be firmly fixed to the restriction member 41 by use of one fixing screw 46 and two press-fitting pins 47. A release window 43*d* for releasing a head of the fixing screw 46 may be formed in the mechanism cover 43.

The restriction arm 45 may include the coupling portion 45*a* and an actuation portion 45*b*. As shown in FIG. 7, the actuation portion 45*b* may be connected to the coupling portion 45*a* such that the actuation portion 45*b* extends rearward. The coupling portion 45*a* is generally formed in a T shape in a right side view. As shown in FIG. 5, the actuation portion 45*b* may extend above the trigger 8. A release window 45*c* may be formed in the actuation portion 45*b*. An end portion of the idler 8*b* may enter and retreat from the release window 45*c*. An end portion of the actuation portion 45*b* may contact the operation portion 12*a* of the energizing switch 12. The energizing switch 12 may be switched on when the actuation portion 45*b* moves upward to cause the operation portion 12*a* of the energizing switch 12 to be pushed on.

Next, a sequence of the driving operation will be explained below in detail. A user may hold the handle 7 and bring the contact portion 15*b* of the contact lever 15 in contact with a material W as shown in FIG. 1. FIG. 1 shows that the trigger 8 is not pull-operated. This state may generally be considered a standby state. As shown in FIGS. 5 and 6, the piston 4 may be retained around a top of the cylinder 3 in the standby state. Accordingly, a lower portion of the driver 11 may be disposed toward an upper side of the driving passage 5*a*. As shown in FIG. 6, in the standby state, the engagement pin 22*b* of the lift wheel 22, which is a last engagement pin in the rotational direction, may engage the lower-end engagement tooth 13*a* of the rack 13 from below.

Figure 9:
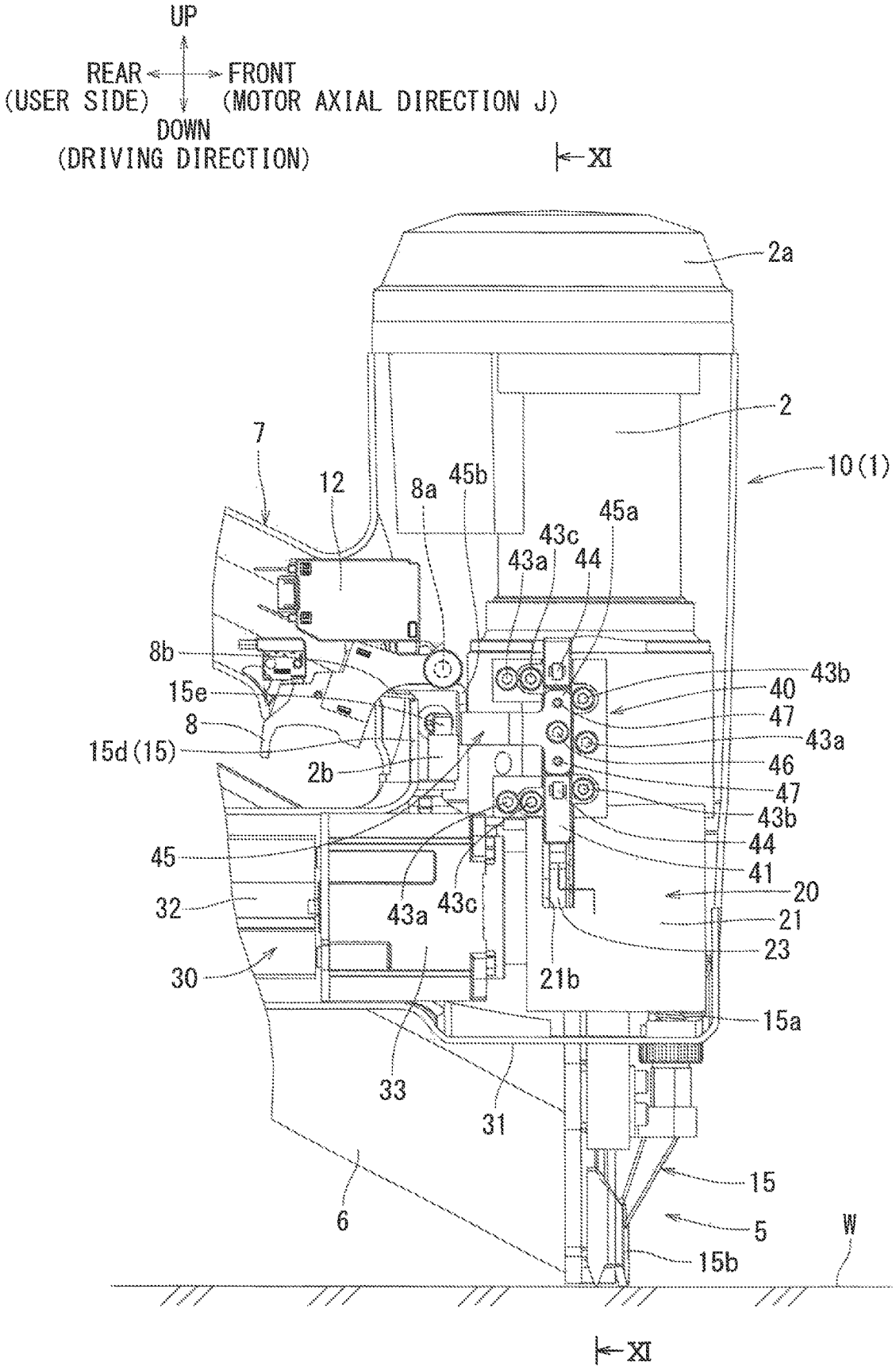
FIG. 9 is a right side view of the tool main body, showing a state immediately before a driving operation is performed, with a trigger being pulled.

As shown in FIGS. 9 and 10, when the driving tool 1 is pushed downward from the standby state so that the contact lever 15 is relatively disposed upward and when the trigger 8 is pulled upward, a driving operation may start. When the contact lever 15 moves relatively upward, the contact sensor 15*c* may be switched on. As the contact lever 15 moves relatively upward, the operation portion 15*d* also may move upward. As shown in FIG. 10, when the trigger 8 is pull-operated, the idler 8*b* may move upward. In this state, since a rotation end tip of the idler 8*b* may be in contact with the operation portion 15*d* of the contact lever 15, the rotation end tip of the idler 8*b* may be prevented from moving downward. Because of this configuration, the actuation portion 45*b* of the activation-state lock mechanism unit 40 may be pushed upward by the idler 8*b*. The operation portion 12*a* of the energizing switch 12 may be pushed upward by the actuation portion 45*b*, thereby causing the energizing switch 12 to be switched on.

At this stage, i.e., when the actuation portion 45*b* is pushed upward by the idler 8*b*, the restriction member 41 of the activation-state lock mechanism unit 40 may be displaced upward (in the disengagement direction relative to the cam 23) against the force of the compression spring 42. In other words, when the contact lever 15 is on-operated and then the trigger 8 is pull-operated, the restriction member 41 may be held at a retracted position in a direction away from the cam 23.

Figure 11:
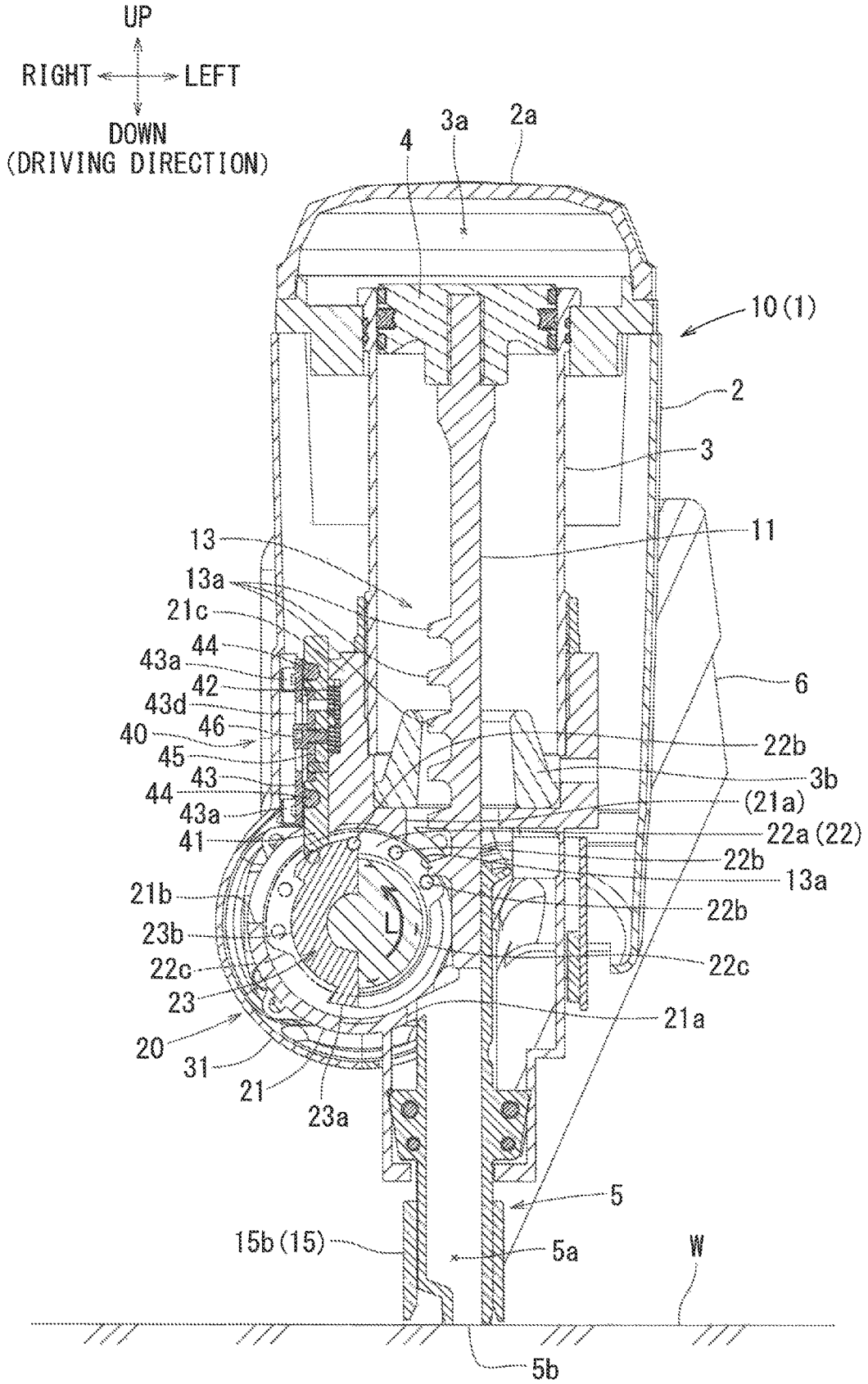
FIG. 11 is a cross-sectional view taken along line XI-XI of FIG. 9, showing a longitudinal sectional view of the tool main body.

When the energizing switch 12 is switched on, the electric motor 32 may be actuated and the lift wheel 22 may start to rotate. As shown in FIG. 11, when the lift wheel 22 rotates counterclockwise as indicated by the arrow L, the last engagement pin 22*b* in the rotational direction may move upward. Then, the lower-end engagement tooth 13*a* of the rack 13 that is engaged with the engagement pin 22*b* may move upward. Because of this movement, the driver 11 may move upward. When the driver 11 moves upward, the piston 4 may reach an upper end position.

When the piston 4 moves from the standby position to the upper end position and immediately before the last engagement pin 22*b* in the rotational direction disengages from the lower-end engagement tooth 13*a*, the restriction member 41 of the activation-state lock mechanism unit 40 may face the on-area 23*a* of the cam 23.

When the piston 4 reaches the upper end position and the lift wheel 22 continues to rotate, the last engagement pin 22*b* in the rotational direction may disengage from the lower-end engagement tooth 13*a* of the rack 13. Because of this configuration, an engagement state of the lift unit 20 with the driver 11 may be released, which allows the piston 4 to move downward owing to the gas pressure within the cylinder upper chamber 3*a*, During this stage, the recessed portion 22*c* of the lift wheel 22 may face the rack 13, and thus the engagement teeth 13*a* may be prevented from being interfered with by the engagement pin 22*b*. As a result, the lift unit 20 may not interfere with the driver 11, which allows the driver 11 to move downward. One driving member N supplied from the magazine 6 to the driving passage 5*a* may be driven by the driver 11 by the downward movement of the piston 4. The driving member N may be driven out of the ejection port 5*b* to hit the material W.

Figure 12:
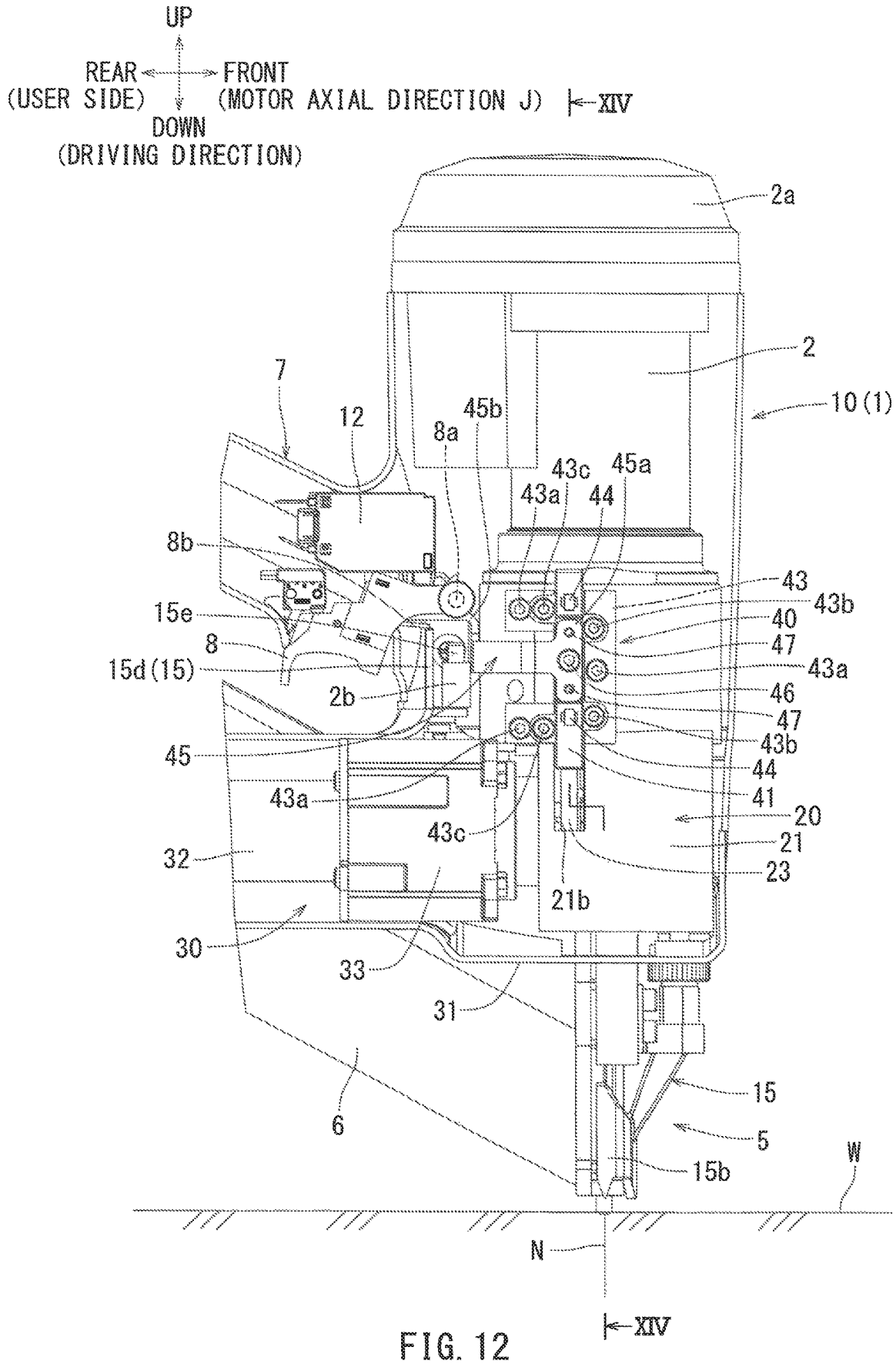
FIG. 12 is a right side view of the tool main body, showing a state where a driver reaches a lower end position to cause a driving member to be driven.
Figure 13:
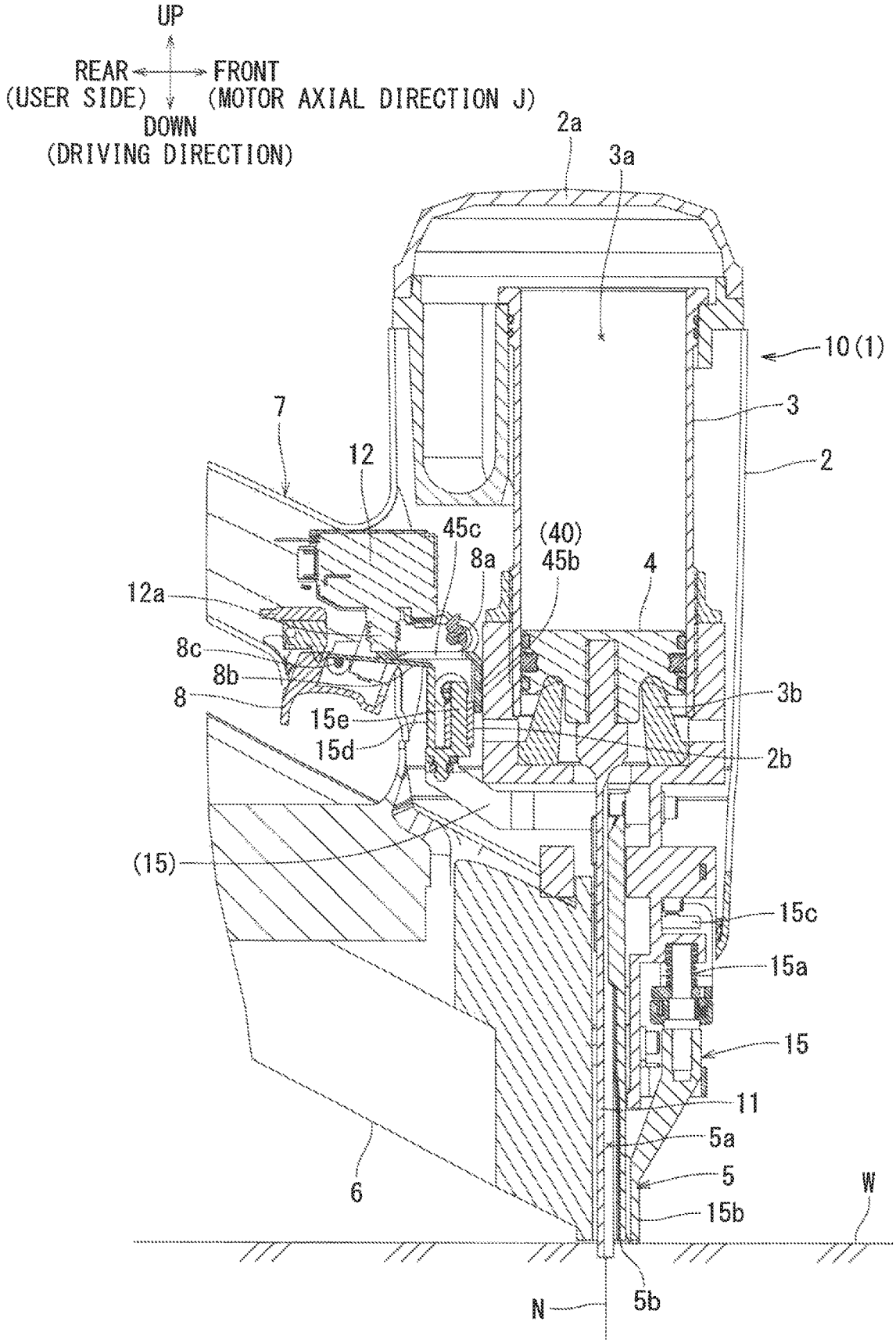
FIG. 13 is a longitudinal sectional view of the tool main body, showing a state where a driving member is driven, similar to FIG. 12.
Figure 14:
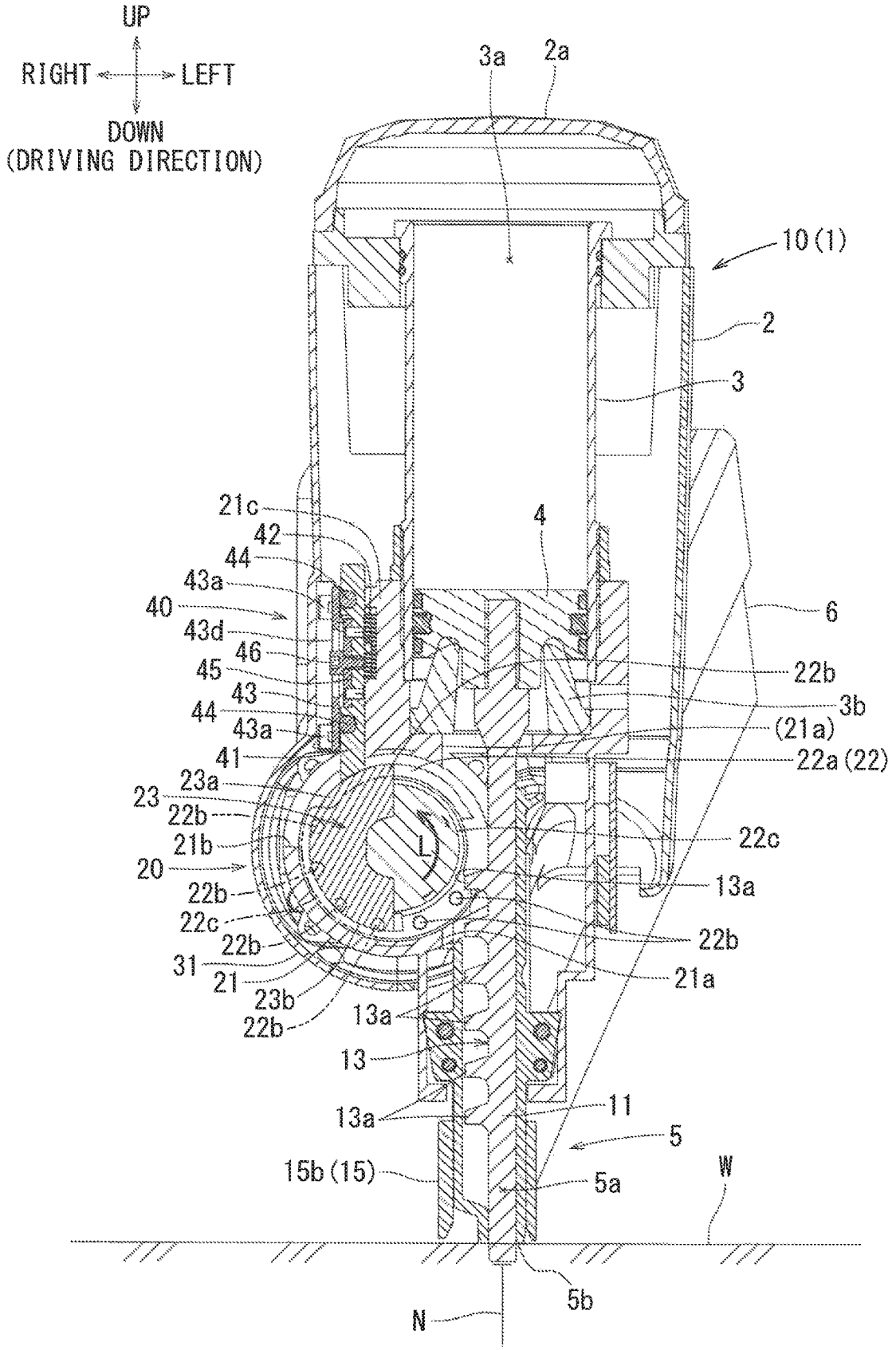
FIG. 14 is a cross-sectional view taken along line XVI-XVI of FIG. 12, showing a longitudinal cross-sectional view of the tool main body.

FIGS. 12 to 13 shows a state where the driving operation has been performed. When the piston 4 reaches the lower end position, an impact that the piston 4 receives in the up-down direction may be absorbed by the lower end damper 3*b*. As shown in FIG. 14, at this stage, a first engagement pin 22*b* of the lift wheel 22 in the rotational direction may be disposed below an upper-end engagement tooth 13*a* of the rack 13. Furthermore, the restriction member 41 may still face the on-area 23*a* of the cam 23.

FIGS. 12 and 13 shows a state where the trigger is still being pulled-operated. After the driving operation has been performed, the pull-operation of the trigger 8 may be released, Because of this operation, the upward movement of the actuation 45*b* by the idler 8*b* may be released. However, at this stage, the activation-state lock mechanism unit 40 may still remain in a lock state. In other words, the restriction member 41 may still face the on-area 23*a* of the cam 23. Because of this configuration, even when the upward movement of the actuation 45*b* by the idler 8*b* has been released, the restriction member 41 may engage the on-area 23*a* of the cam 23, and thus the restriction member 41 may be prevented from moving downward. As a result, a downward movement of the actuation portion 45*b* may be restricted, which causes the actuation portion 45*b* to continue pushing the operation portion 12*a* of the energizing switch 12. That is, the energizing switch 12 may remain to be switched on.

As discussed above, even after the pull-operation of the trigger 8 has been released, the energizing switch 12 may remain to be switched on by the activation-state lock mechanism unit 40. Thus, the electric motor 32 may continue to rotate. The lift wheel 22 may continue to rotate in a direction L indicated by the arrow in the figures.

Since the electric motor 32 continues to rotate after the operation of the trigger 8 has been released, an upper-end engagement tooth 13*a* of the rack 13 may engage the first engagement pin 22*b* of the lift wheel 22 in the rotational direction. By the continuous rotation of the lift wheel 22 in the direction L, each of the engagement pins 22*b* may successively engage a corresponding engagement tooth 13*a*. Because of this configuration, the driver 11 and the piston 4 may move upward. Furthermore, during this period, the restriction member 41 may continue to be engaged with the on-area 23*a* of the cam 23. Thus, the energizing switch 12 may remain switched on. As a result, the electric motor 32 may continue to rotate.

When the piston 4 returns to the standby position as shown in FIG. 6, the last engagement pin 22*b* of the lift wheel 22 in the rotational direction may engage the lower-end engagement tooth 13*a* from below. At this stage, a facing portion of the cam 23, which is a portion that faces the restriction member 41, may transfer from the on-area 23*a* to the off-area 23*b*. That is, the restriction member 41 may face the off area 23*b* of the cam 23 at this stage.

When the facing portion of the cam 23, which faces the restriction member 41, transfers from the on-area 23*a* to the off-area 23*b*, the restriction member 41 may be allowed to move downward. Accordingly, the restriction member 41 may be moved downward due to the biasing force of the compression spring 42, as well as a return force of the energizing switch 12 to an off position (biasing force of the operation portion 12*a* to the off position). As a result, as shown in FIG. 6, the restriction member 41 may return to a standby state where the restriction member 41 engages or projects toward the off-area 23*b* (a release state of the activation-state lock mechanism unit 40).

As discussed above, the lock state of the activation-state lock mechanism unit 40 may be released and the operation portion 12*a* of the energizing switch 12 may be returned to the off position. Thus, the electric motor 32 may stop, and one sequence of the driving operation may be completed.

The driving tool 1 according to the present embodiment may include a function (driving mode select function) in which a driving operation between the single shot mode and a continuous shot mode may be selected. In the single shot mode, after one driving operation has been completed, both the off-operations of the trigger 8 and the contact lever 15 may be needed to allow a next driving operation. The single shot mode may also be referred to as an aimed shot mode. In other words, a driving operation may be performed accurately. In the continuous shot mode, a driving operation may be continuously performed by repeating an on-operation of the contact lever 15 while the trigger 8 is being pull-operated. The continuous shot mode may also be referred to as a swing shot mode. In other words, multiple driving operations may be performed rapidly. (Furthermore, a drag driving operation may be performed. In more detail, the drag driving operation can be performed when the trigger 8 is pull-operated while the driving tool 1 is moved with the contact lever 15 being on-operated.)

Figure 15:
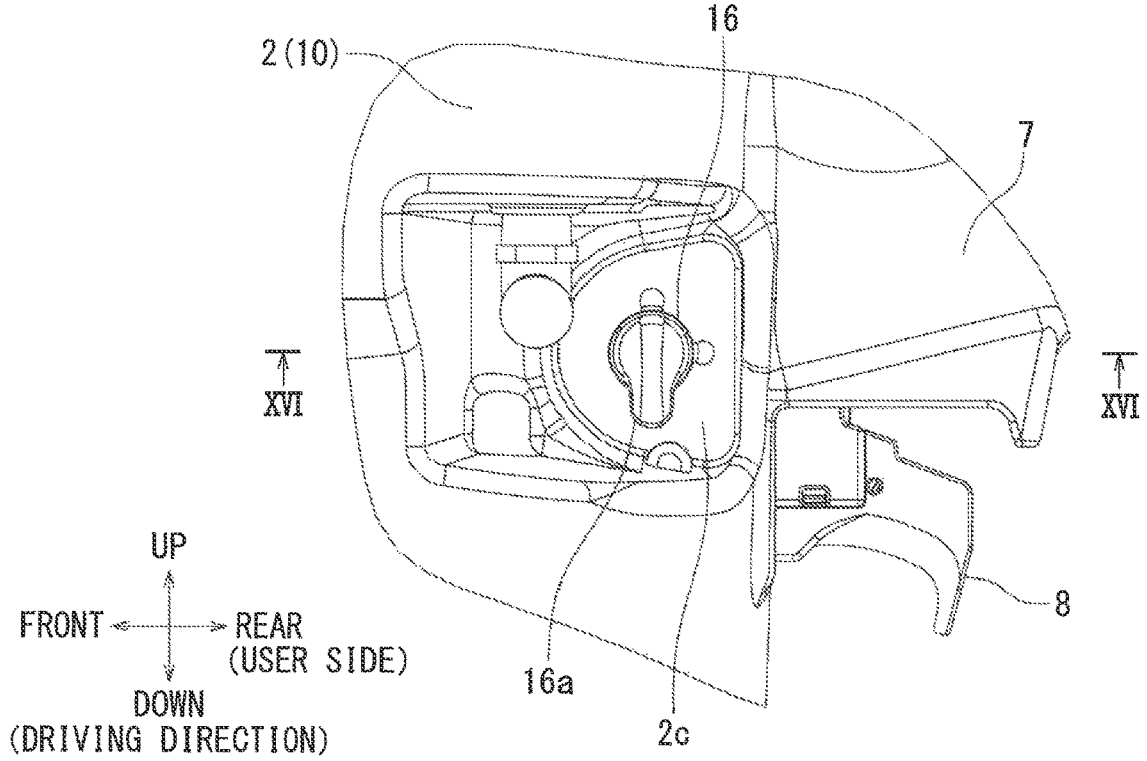
FIG. 15 is a left side view of the tool main body showing a mode selector viewed from the left side. This figure shows a single shot mode.
Figure 16:
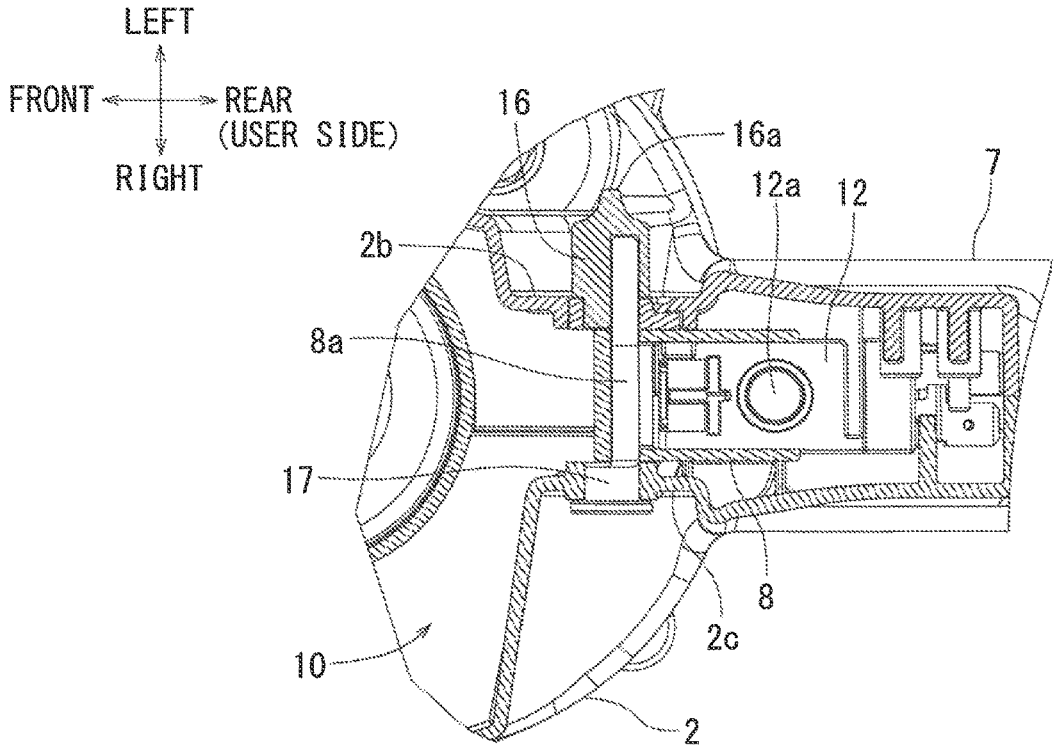
FIG. 16 is a cross-sectional view taken from line XVI-XVI of FIG. 15, which shows a transverse cross-sectional view of a trigger support portion.

As shown in FIGS. 15 and 16, a mode select lever 16 in a tubular shape may be mounted at a left end of the trigger pivot 8*a* of the trigger 8 on a left side of the tool main body 10. A knob 16*a*, which extends in one circumferential direction, may be integrally formed on a left end surface of the mode select lever 16. An eccentric support portion 17 may be connected on the right end of the trigger pivot 8*a*. The mode select lever 16 and the eccentric support portion 17 may be rotatably supported by a left and right support wall 2*c*, respectively. The left and right support wall 2*c* may be provided on the rear side of the main body housing 2, such that the left support wall 2*c* faces the right support wall 2*c*. The trigger pivot 8*a* may be supported straddling the left and right support walls 2*c* via the mode select lever 16 and the eccentric support portion 17.

A rotational axis of the mode select lever 16 may align a rotational axis of the eccentric support portion 17 relative to the support wall 12*c*. The trigger pivot 8*a* may be supported so as to be eccentric relative to the rotation axis of the mode select lever 16. The trigger pivot 8*a* may also be eccentric to the eccentric support portion 17. Because of this configuration, when the mode select lever 16 is rotated by use of the knob 16*a*, the trigger pivot 8*a* may move in the front-rear direction (in the radial direction). In the present embodiment, when the knob 16*a* is turned downward as shown in FIG. 15, the trigger pivot 8*a* may move in the rearward direction (toward the side of the user). Thus, the entirety of the trigger 8 may move toward the side of the user. In this embodiment, an operation mode of the tool main body 10 may be the single shot mode.

Figure 20:
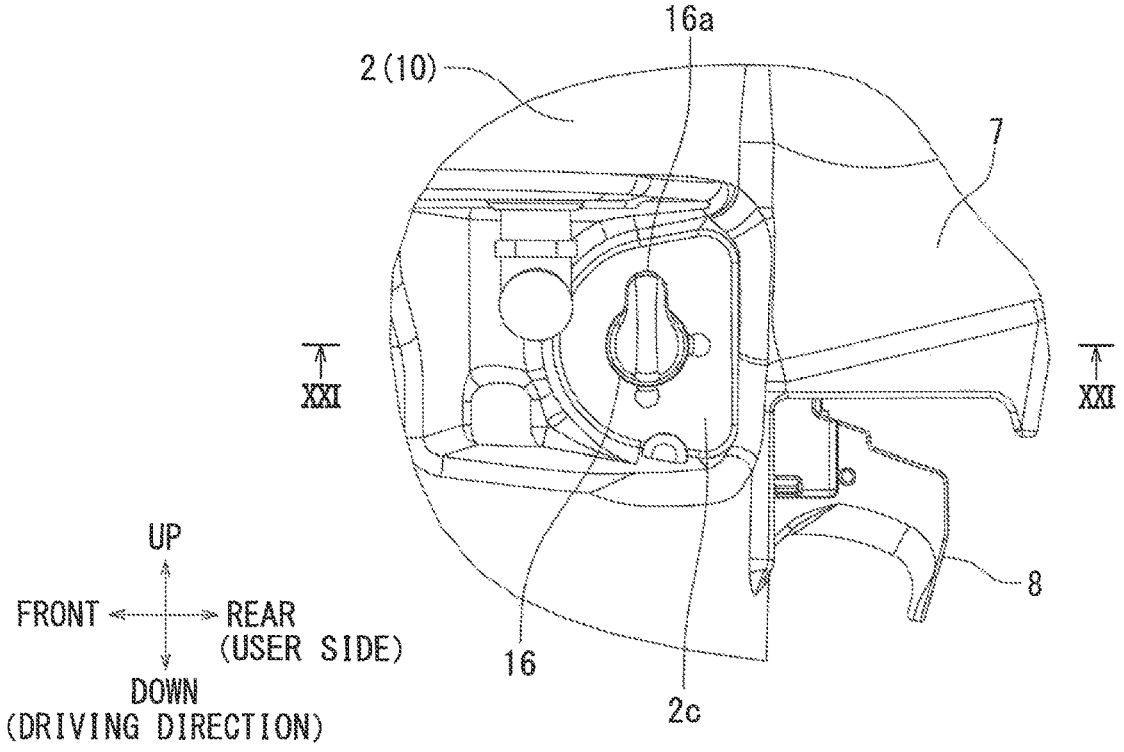
FIG. 20 is a left side view of the tool main body, showing the mode selector viewed from the left side. This figure shows a continuous shot mode.
Figure 21:
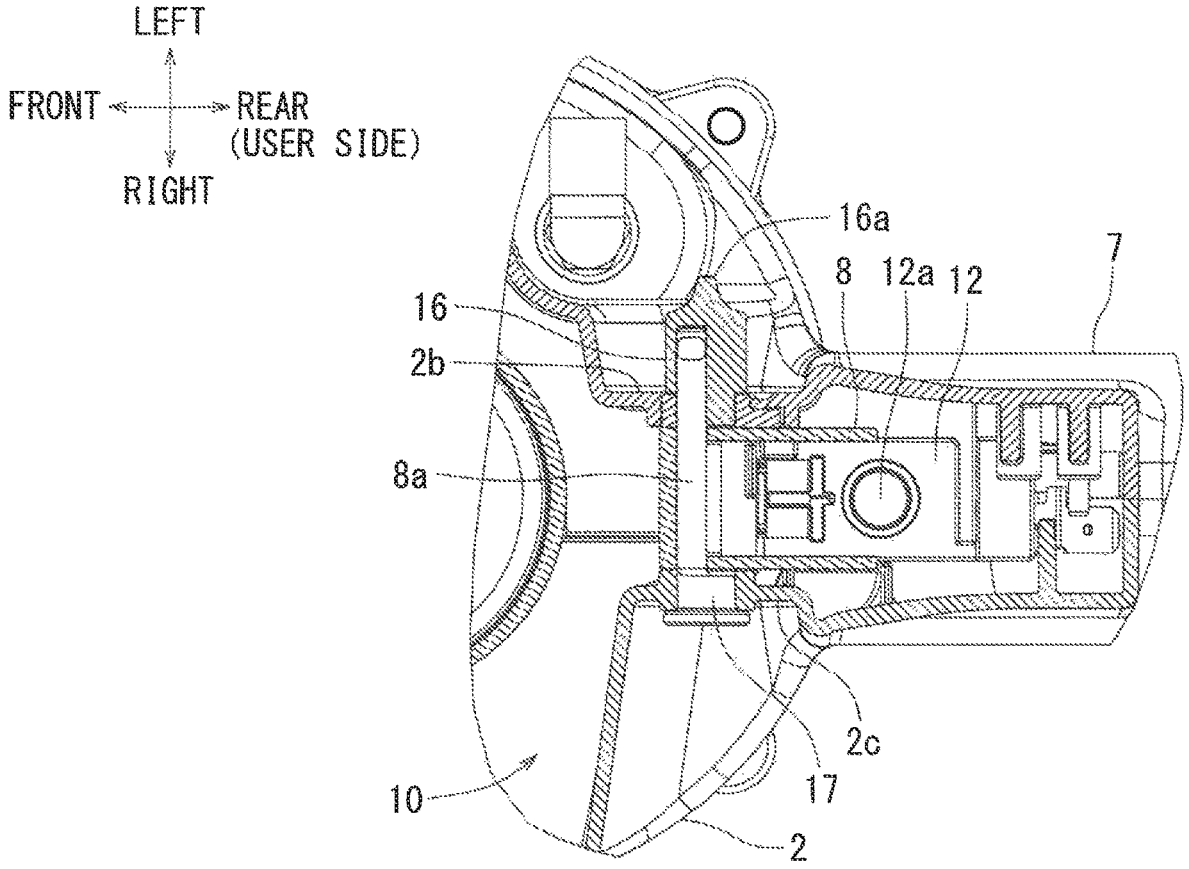
FIG. 21 is a cross-sectional view taken from line XXI-XXI of FIG. A, which shows a transverse cross-sectional view of the trigger support portion.

When the mode select lever 16 is rotated by 180°, from a position of the single shot mode shown in FIG. 15, in other words, when the knob 16*a* is turned upward as shown in FIG. 20, the trigger pivot 8*a* may move in the forward direction, as shown in FIG. 21. Thus, the entirety of the trigger 8 may move in a direction away from the user (frontward). In this embodiment, the operation mode of the tool main body 10 may be switched from the single shot mode to the continuous shot mode. In this way, by rotating the mode select lever 16 by 180°, the trigger pivot 8*a* may move in the front-rear direction, which causes the operation mode to switch between the single shot mode and the continuous shot mode.

Figure 17:
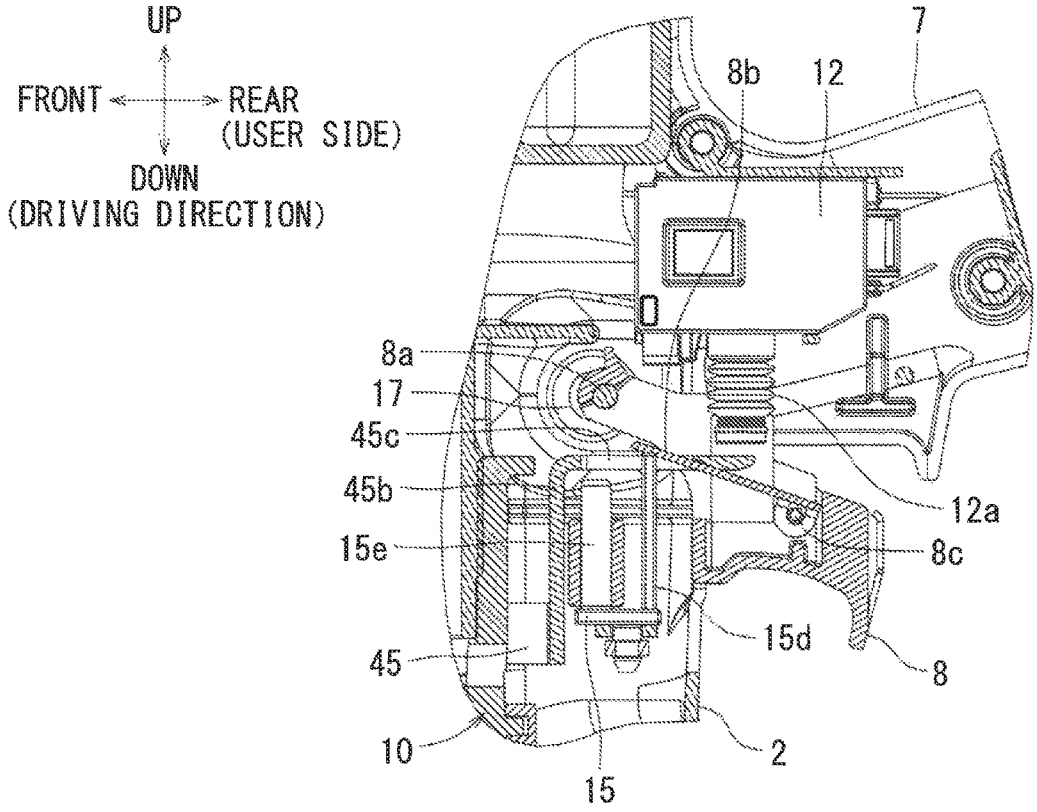
FIG. 17 is a longitudinal cross-sectional view around the trigger support portion. This figure shows that a contact lever is in an on-state and the trigger is in an off state when the single shot mode is selected.
Figure 18:
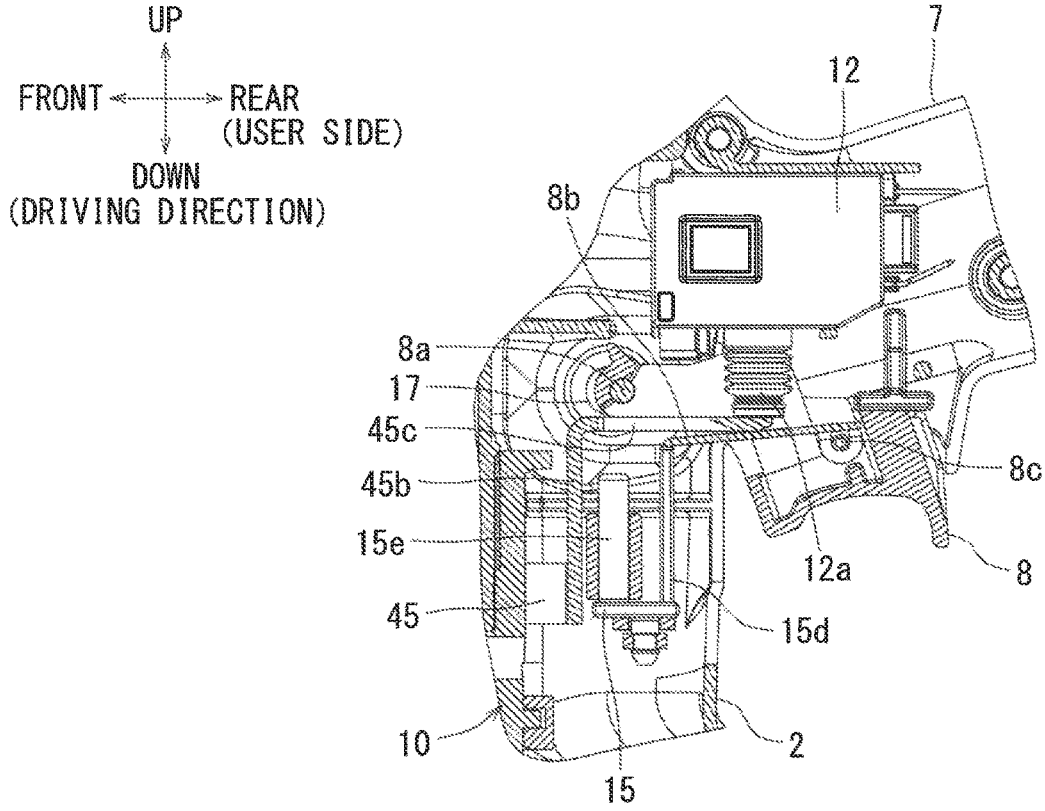
FIG. 18 is a longitudinal cross-sectional view around the trigger support portion. This figure shows that the contact lever is in an on-state and the trigger is in an on-state when the single shot mode is selected.
Figure 19:
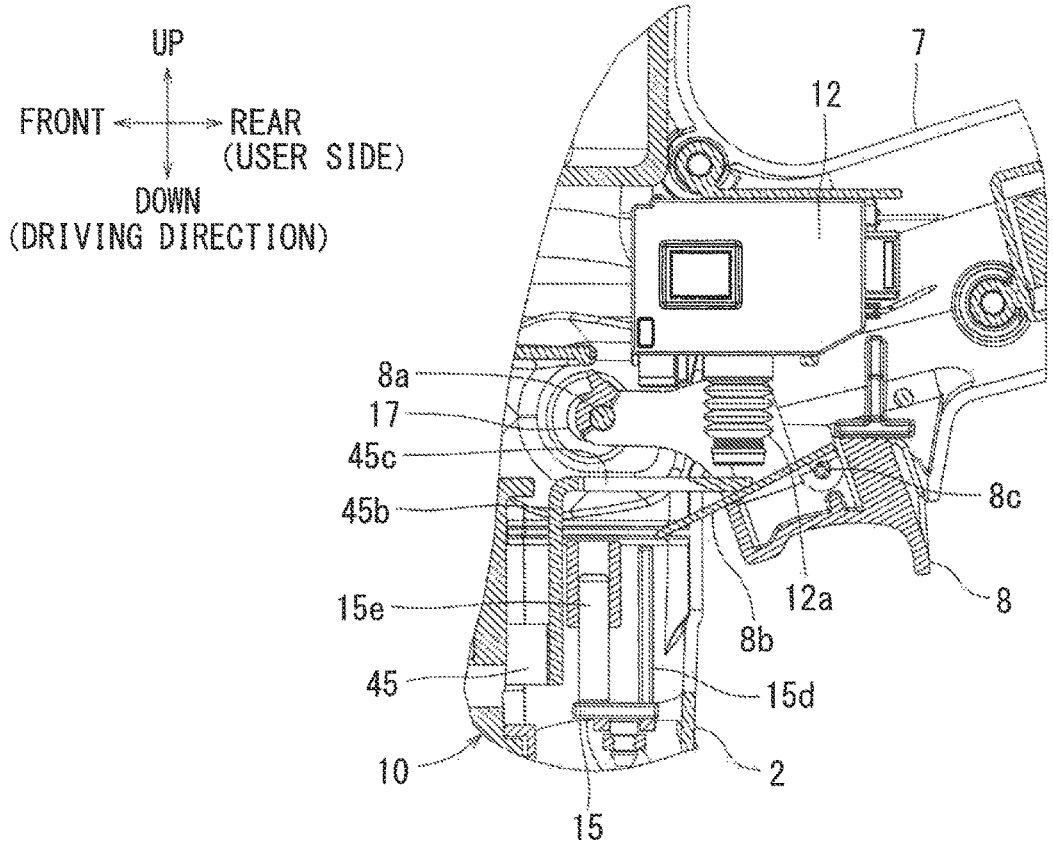
FIG. 19 is a longitudinal cross-sectional view around the trigger support portion. This figure shows that the contact lever is in an off-state and the trigger is in an on-state when the single shot mode is selected.

FIGS. 17 to 19 show movements of the trigger 8 and related members in the single shot mode. As shown in FIG. 17, when the contact lever 15 is on-operated at first, the operation portion 15*d* may move upward to cause the upper portion of the operation portion 15*d* to contact the lower surface of the rotation tip end of the idler 8*b*. Because of this configuration, the rotation tip end of the idler 8*b* may be prevented from moving downward. Furthermore, the idler 8*b* may contact the edge of the release window 45*c* of the restriction arm 45. Because of this configuration, as shown in FIG. 18, when the trigger 8 is pull-operated after that, the idler pivot 8*c* may move upward while the rotation tip end of the idler 8*b* is being prevented from moving downward. As a result, the idler 8*b* may be moved upward by a predetermined length. The upward movement of the idler 8*b* may cause the actuation portion 45*b* of the restriction arm 45 to push the operation portion 12*a* of the energizing switch 12. Then, the tool main body 10 may perform a driving operation.

As shown in FIG. 19, in the single shot mode, when the trigger 8 is pull-operated upward at first, the rotation tip end of the idler 8*b* may be offset away from a movement passage of the operation portion 15*d* of the contact lever 15 in the up-down direction. Because of this configuration, even when the contact lever is on-operated after that, the operation portion 15*d* may not contact the idler 8*b*. Instead, the operation portion 15*d* may move upward passing by the idler 8*b*. Thus, the rotation tip end of the idler 8*b* may not move upward and the energizing switch 12 may not be switched on. As a result, the on-operation of the contact lever 15 may not be effective and a driving operation may not be performed. This ineffective state may be cancelled by a release of the pull-operation of the trigger 8, and in some embodiments also off-operating the contact lever 15.

Figure 22:
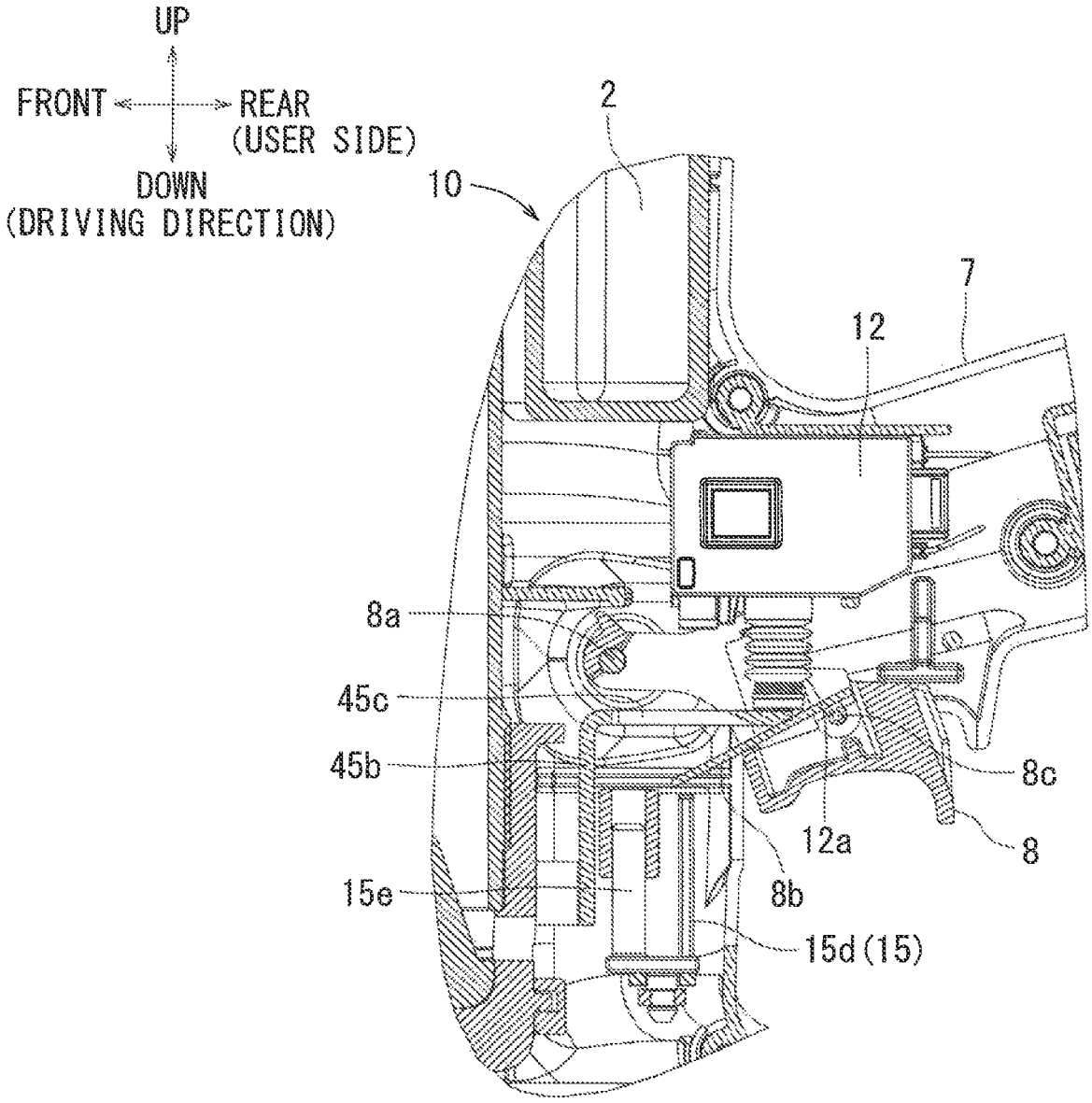
FIG. 22 is a longitudinal cross-sectional view around the trigger support portion. This figure shows that the contact lever is in an off-state and the trigger is in an on-state when the continuous shot mode is selected.
Figure 23:
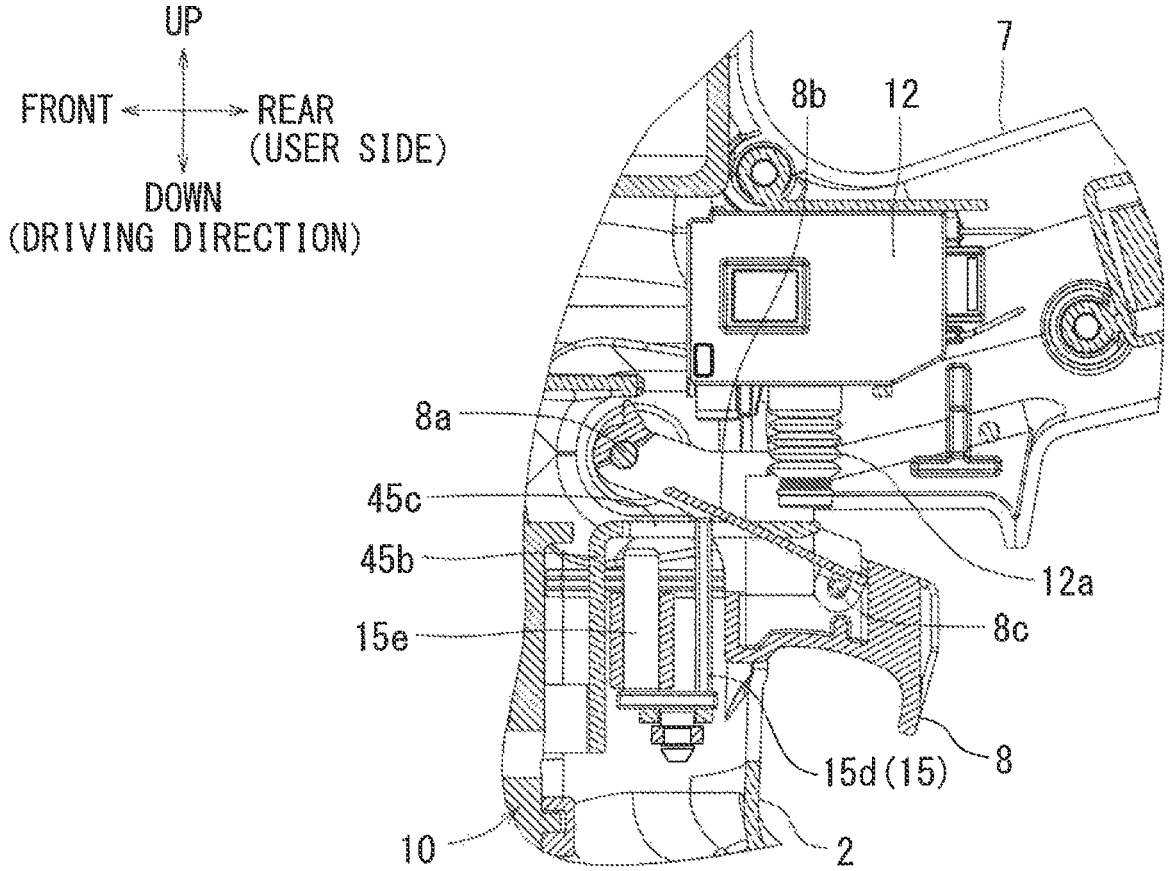
FIG. 23 is a longitudinal cross-sectional view around the trigger support portion. This figure shows that the contact lever is in an on-state and the trigger is in an off-state when the continuous shot mode is selected.

FIGS. 22 and 23 show movements of the trigger 8 and related members in the continuous shot mode. When the knob 16*a* is turned, upward as shown in FIG. 20, to place the mode select lever 16 in the position to select the continuous mode, the trigger pivot 8*a* may move forward and thus the entire of the trigger 8 may move forward, as shown in FIG. 21. Because of this configuration, in the continuous shot mode, if the trigger 8 is on-operated at first, as shown in FIG. 22, and then the contact lever 15 is on-operated, the operation portion 15*d* of the contact lever 15 may push the idler 8*b* upward to cause the energizing switch 12 to switch on. In the continuous shot mode, even if the trigger 8 is on-operated at first, the idler 8*b* may be positioned above the operation portion 15*d* because the entirety of the trigger 8 has been moved forward. In other words, in the continuous mode, the operation portion 15*d* may engage the idler 8*b*, and thus the energizing switch 12 may be switched on, regardless of the operation order of the on-operation of the trigger 8 and the on-operation of the contact lever 15. In contrast, in the single shot mode, as discussed above, when the trigger 8 is on-operated at first, the idler 8*b* may move so that it is not positioned above the operation portion 15*d*. This is because the entirety of the trigger 8 has been moved rearward, an embodiment of which is shown in FIG. 19.

In the continuous shot mode, driving operations may be repeated to perform continuous driving by repeating the on-operation of the contact lever 15 while the trigger 8 is continuously being on-operated. Furthermore, in the continuous shot mode, when the contact lever 15 is on-operated at first and then the trigger 8 is pull-operated, the idler 8*b* may be pushed upward by the operation portion 15*d* to allow for the energizing switch 12 to switch on. Accordingly, a driving operation (for instance an aimed shot) may be performed. After this driving operation, while the trigger 8 is still being on-operated, the contact lever 15 may be off-operated, the tool main body 10 may then be moved to a next position, and then the contact lever 15 may be on-operated again. By performing this procedure, a continuous driving may be performed.

As discussed above, the driving tool 1 according to the present embodiment may have the function of selecting the driving mode (driving mode select function) between the single shot mode and the continuous shot mode. The driving mode may be selected by a simple operation of turning the mode select lever 16, for instance, by 180°, which may be provided on the left side of the tool main body 10. By use of the mode select function, the driving tool 1 can be used in an appropriate manner according to various work conditions. In this respect, operability of the driving tool 1 can be improved.

According to the driving tool 1 discussed above, the electric motor 32 may continue to rotate to return the driver 11 to the standby position after the driving operation has been completed, regardless of the on-operation of the trigger 8. This may be done by use of the activation-state lock mechanism unit 40, including the restriction member 41, and mechanical configuration including the cam 23 of the lift unit 20.

According to the present embodiment, the electric motor 32 may continue to rotate to cause the driver 11 to be returned to the standby position because of a mechanical configuration. Thus, malfunction, which sometimes occurs when the motor activation is electrically controlled as in the prior art, can be prevented. Furthermore, the activation-state lock mechanism unit 40 can be adapted to a gas-spring type driving tool 1, instead of being limited to a mechanical-spring type driving tool.

Furthermore, according to the configuration discussed above, when trigger 8 is on-operated, the idler 8*b* may push the actuation portion 45*b* of the restriction arm 45 upward to cause the operation portion 12*a* of the energizing switch 12 to move upward to cause the energizing switch 12 to switch on. Because of this configuration, when the trigger 8 is on-operated, the restriction member 41 may move to the lock position. In this way, the pull-operation of the trigger 8 toward the on-position may be associated with the movement of the restriction member 41. Because of this configuration, the on-state of the energizing switch 12 may be configured to be retained in a certain position by using a simple structure, in comparison with a configuration in which the pull-operation of the trigger 8 is not associated with the movement of the restriction member 41. In case where they are not associated with each other, a member for restricting a movement of the operation portion 12*a* of the energizing switch 12 may be provided separately from the actuation portion 45*b*, which may be contacted by the idler 8*b* of the trigger 8.

Furthermore, the cam 23 may be provided coaxially with the lift wheel 22. Thus, the lift unit 20 and the activation-state lock mechanism unit 40 can be compactified.

Furthermore, the on-area 23*a*, which has a large radius, and the off-area 23*b*, which has a small radius, may be formed as part of the circumference of the cam 23. The on-area 23*a* and the off-area 23*b* may face the restriction member 41 in an appropriate manner, for instance according to the rotation of the cam 23. Thus, the restriction member 41 may be moved between the lock position and the unlock position at an appropriate timing.

Furthermore, in a side view of the driver 11 to the trigger 8, the restriction member 41 and the cam 23 may be disposed between the driver 11 and the trigger 8. In other words, the restriction member 41 and the cant 23 may be disposed in an area where a required space can be obtained in a relatively easily manner. Thus, the driving tool 1 can be compactified.

Furthermore, according to the exemplified embodiment, movement of the restriction member 31 may be guided by guide rollers, i.e., side rollers 44, the first rollers 43*b*, and the second rollers 43*c*. Because of these guide rollers, the restriction member 41 can smoothly move between the lock position and the unlock position, even when the restriction 41 receives a force from a side thereof.

Furthermore, according to the exemplified embodiment of the driving tool 1, because the activation state of the electric motor 32 is controlled by use of a mechanical configuration, malfunctions, which sometimes occur when the activation state of the electric motor 32 is electrically controlled, can be prevented. In addition to this, the driving tool 1 may have a single shot mode and a continuous mode, thereby further improving the operability of the driving tool 1.

The driving tool 1 according to the exemplified embodiment may be further modified. In the exemplified embodiment, the restriction member 41 may move to the lock position by the on-operation of the trigger 8. However, apart from the on-operation of the trigger 8, the restriction member 41 may move to the lock position when the restriction member 41 engages the on-area 23*a*, for instance according to the rotation of the cam 23. In this modified configuration, the actuation portion 45*b* of the restriction arm 45 may engage the operation portion 12*a* of the energizing switch 12 at a position separate from that of the idler 8*b*, for example, at a position closer to a base of the operation portion 12*a*. Because of this configuration, the operation portion 12*a* of the energizing switch 12 may be restricted from moving to the off-position, which causes the energizing switch 12 to continue to be switched on after the trigger 8 has been off-operated.

Furthermore, in the exemplified embodiment, the engagement pin 22*b* may engage the engagement tooth 13*a* of the rack 13. However, instead of the engagement pin 22*b*, a gear tooth may be configured to engage the engagement tooth 13*a* of the rack 13.

Furthermore, in the exemplified embodiment, the driving tool 1 that drives a nail as a driving member N may be exemplified. However, the lift 20 and the activation-state lock mechanism unit 40 may be applied to a driving tool that drives other driving members, for instance a staple.

In some embodiments, the cam 23 may have a different shape and/or orientation from that described above. For instance, the cam 23 may be rotated, relative to the lift wheel 22, by about 80° in the clockwise direction from the relative position of the cam 23 depicted in FIGS. 8 and 14. With such an orientation, the trailing edge of the on-area 23*a* of the cam 23 may be configured to contact a side surface, for instance the right side surface, of the restriction member 41. For example, a surface that extends from the off-area 23*b* to the on-area 23*a* may contact a surface of the restriction member 41 when the piston 4 is in the standby position. This may allow the restriction member 41 to prevent the lift wheel 22, via the cam 23, from rotating in a direction opposite to the lifting direction (e.g., clockwise in the Drawings). Additionally, the restriction member 41 may function as a fail-safe by preventing the lift wheel 22 from rotating in the direction opposite the lifting direction when the piston 4 is in the standby state, in the event that other safety features, if present, malfunction.

Another possible benefit of the cam 23 in the above described orientation is that it allows for some operation time before the restriction member 41 becomes aligned with the on-area 23*a* of the cam 23. For instance, when the piston 4 is in the standby position, a portion of the off-area 23*b* of the cam 23 may be positioned between the restriction member 41 and the leading edge of the on-area 23*a*. This configuration may require the trigger 8 to be pulled for a certain period of time before the restriction member 41 is aligned with the on-area 23*a*, thereby causing the restriction member 41 to be in the locked position even if the trigger 8 is released. By ensuring that the trigger 8 is pulled for a certain amount of time before the energizing switch 12 is kept on by the restriction member 41, accidental short pulls of the trigger may be prevented from causing a driving operation, thereby improving safety.

In some embodiments, the leading and/or trailing portions of the on-area 23*a* of the cam 23 may have a different shape than another portion of the on-area 23*a* of the cam 23. For instance, the leading and/or trailing portion of the on-area 23*a* may have a sloped, chamfered, curved, indented, etc. shape. Some embodiments of the various shapes that these portions may have are depicted in FIG. 8.

In some embodiments, the relative sizes of the on-area 23*a* and the of 23*b* of the cam 23 may be selected as appropriate. For instance, the on-area 23*a* of the cam 23 may be substantially larger than the off-area 23*b* of the cam 23. For example, the off-area 23*b* may merely correspond to the standby position of the piston 4. This may allow the restriction member 41 to be maintained in the locked position for times other than when the piston 4 is in the vicinity of the standby position.

In some embodiments, the on-area 23*a* and the off-area 23*b* may be integrated into other components. For instance, the on-area 23*a* and the off-area 23*b* may be positioned on components such as, for example, the lift unit 20 or the driver 11. As one example, the on-area 23*a* and the off-area 23*b* may be positioned to project from a side surface of a flange portion 22*a* of the lift wheel 22. As another example, the on-area 23*a* and the off-area 23*b* may be positioned on a circumferential edge of a flange portion 22*a* of the lift wheel 22. By forming the on-area 23*a* and off-area 23*b* integrally with another component, the cam 23 may be omitted, thereby reducing the number of parts and facilitating assembly.

What is claimed is:

1. A driving tool, comprising:

a cylinder;

a piston that is housed within the cylinder and configured to be reciprocated in an up-down direction;

a driver that is fixed to the piston and configured to move downward in a driving direction;

a lift wheel that engages a rack of the driver;

an electric motor that is configured to rotate the lift wheel;

a trigger configured to be movable to an on-position;

an energizing switch configured to be switched on to cause the electric motor to be activated by a movement of the trigger to the on-position;

a restriction member configured to move between a lock position, where the energizing switch is retained in an on-state, and an unlock position, where the energizing switch is allowed to be in an off-state; and a cam connected to the lift wheel, the cam including (i) an on-area configured to engage the restriction member such that the restriction member is retained in the lock position and (ii) an off-area configured to allow the restriction member to move to the unlock position, wherein the cam is configured to rotate coaxially with the lift wheel.

2. The driving tool according to claim 1, wherein the restriction member is configured to move to the lock position by moving the trigger to the on-position.

3. The driving tool according to claim 1, wherein:

the on-area of the cam has a first radius; and the off-area of the cam has a second radius that is smaller than the first radius.

4. The driving tool according to claim 3, wherein the restriction member is configured to engage the on-area of the cam when the driver moves from a lower end position to a predetermined position, the predetermined position being a standby position or a position in a vicinity of the standby position.

5. The driving tool according to claim 1, wherein the restriction member and the cam are between the trigger and the driver in a side view.

6. The driving tool according to claim 5, further comprising guide rollers that are configured to guide the movement of the restriction member.

7. The driving tool according to claim 6, wherein the guide rollers are on sides of the restriction member and configured such that when the cam applies a force to the restriction member in a direction perpendicular to an up-down direction in which the restriction member moves, the restriction member receives forces from opposite direction from the rollers.

8. The driving tool according to claim 6, wherein the guide rollers are configured to guide the restriction member on at least one side in a direction parallel to a rotation axis of the cam, the direction being perpendicular to the direction in which the restriction member moves.

9. The driving tool according to claim 1, wherein:

the driving tool is configured such that a driving operation is performed when both the trigger and a contact lever are on-operated to cause an idler of the trigger to engage an operation portion of the contact lever and to then switch on the energizing switch;

the driving operation includes a single shot mode and a continuous shot mode;

the single shot mode is a mode in which, when the contact lever is on-operated after the trigger is on-operated, the idler disengages from the operation portion of the contact lever to prevent the energizing switch from being switched on by the idler; and the continuous shot mode is a mode in which the idler engages the operation portion of the contact lever to cause the energizing switch to be switched on by the idler, regardless of an order of the on-operation of the trigger and the on-operation of the contact lever.

10. The driving tool according to claim 9, wherein:

a portion of the restriction member is between the energizing switch and the idler; and the driving tool is configured such that both the on-operation of the trigger and the on-operation of the contact lever cause the idler to push the restriction member, thereby moving the restriction member to the lock position.

11. The driving tool according to claim 9, wherein the single shot mode and the continuous shot mode are selectable by shifting a position of the trigger relative to a housing of the driving tool.

12. The driving tool according to claim 1, wherein the driving tool is configured such that, when the restriction member is retained in the lock position, the electric motor is activated regardless of whether the trigger is in the on-position.

13. The driving tool according to claim 1, wherein the driving tool is configured such that the energizing switch is retained in the on-state for a portion of the time the lift wheel is rotating, regardless of whether the trigger in in the on-position.

14. The driving tool according to claim 1, wherein the driving tool is configured such that the energizing switch is retained in the on-state for at least a portion of the time the driver is moving in a direction opposite to the driving direction.

15. A driving tool, comprising:

a cylinder;

a piston that is housed within the cylinder and configured to be reciprocated in an up-down direction;

a driver that is fixed to the piston and configured to move downward in a driving direction;

a lift wheel that engages a rack provided in the driver;

an electric motor that is configured to rotate the lift wheel;

a trigger configured to be movable to an on-position;

an energizing switch configured to be switched on to cause the electric motor to be activated by a movement of the trigger to the on-position;

a restriction member configured to move between a lock position, where the energizing switch is retained in an on-state, and an unlock position, where the energizing switch is allowed to be in an off-state;

a contact lever including an operation portion; and an idler in the trigger, wherein the driving tool is configured such that:

for at least a portion of the time the electric motor is rotating the lift wheel, the restriction member is configured to retain the energizing switch in the on-state regardless of whether the trigger is in the on-position; and a driving operation is performed when both the trigger and the contact lever are on-operated to cause the idler of the trigger to engage an operation portion of the contact lever and to then switch on the energizing switch.

16. The driving tool according to claim 15, wherein:

a portion of the restriction member is between the energizing switch and the idler; and the driving tool is configured such that both the on-operation of the trigger and the on-operation of the contact lever cause the idler to push the restriction member, thereby moving the restriction member to the lock position.

17. The driving tool according to claim 15, wherein the driving tool is configured such that the restriction member retains the energizing switch in the on-state for at least a portion of the time the driver moves in a direction opposite to the driving direction.

18. The driving tool according to claim 15, wherein the driving tool is configured such that the restriction member retains the energizing switch in the on-state for at least a portion of the time between a driving operation having been completed and the piston having returned to a standby position.

* * * * *